US011085442B2

(12) United States Patent
Murphy

(10) Patent No.: US 11,085,442 B2
(45) Date of Patent: Aug. 10, 2021

(54) ROTARY DRIVE WITH PIVOTING STATOR AND ROTOR VANES

(71) Applicant: Monashee Pumps Inc., Halifax (CA)

(72) Inventor: Braden Murphy, Calgary (CA)

(73) Assignee: Monashee Pumps Inc., Halifax (CA)

( * ) Notice: Subject to any disclaimer, the term of this patent is extended or adjusted under 35 U.S.C. 154(b) by 271 days.

(21) Appl. No.: 16/158,606

(22) Filed: Oct. 12, 2018

(65) Prior Publication Data

US 2019/0195222 A1 Jun. 27, 2019

Related U.S. Application Data

(63) Continuation of application No. PCT/CA2017/050460, filed on Apr. 13, 2017.

(60) Provisional application No. 62/409,161, filed on Oct. 17, 2016, provisional application No. 62/322,519, filed on Apr. 14, 2016.

(51) Int. Cl.

| | |
|---|---|
| ***F04C 2/40*** | (2006.01) |
| ***F01C 21/08*** | (2006.01) |
| ***F04C 13/00*** | (2006.01) |
| ***F01C 1/40*** | (2006.01) |
| ***F01C 1/44*** | (2006.01) |

(52) U.S. Cl.

CPC ..... *F04C 2/40* (2013.01); *F01C 1/40* (2013.01); *F01C 1/44* (2013.01); *F01C 21/0809* (2013.01); *F04C 13/008* (2013.01)

(58) Field of Classification Search

CPC ..... F01C 1/40; F01C 21/0809; F04C 2/40

See application file for complete search history.

(56) References Cited

U.S. PATENT DOCUMENTS 669,035 A * 2/1901 Newton ..... F01C 21/0809 418/221

865,967 A * 9/1907 Harriman ..... F01C 21/0809 418/221

(Continued)

FOREIGN PATENT DOCUMENTS

| | | |
|---|---|---|
| CN | 1025967 C | 9/1994 |
| DE | 4427105 C1 | 1/1996 |
| WO | 2014121872 A2 | 8/2014 |

OTHER PUBLICATIONS

International Search Report and Written Opinion of corresponding International Application No. PCT/CA2017/050460 dated Jul. 31, 2017.

*Primary Examiner* — Mary Davis

(74) *Attorney, Agent, or Firm* — Bereskin & Parr LLP/S.E.N.C.R.L., S.R.L.

(57) ABSTRACT

A rotary drive includes a housing; a shaft rotatably mounted within the housing and rotatable about a drive axis; a passage internal the housing and extending circumferentially about the shaft; a stator vane within the passage; and a rotor vane within the passage. The stator and rotor vanes are movable between respective closed positions in which the stator and rotor vanes separate the passage into a circumferentially expanding chamber in fluid communication with an inlet in the housing and a circumferentially collapsing chamber in fluid communication with an outlet in the housing, and respective open positions in which the rotor vane is movable circumferentially past the stator vane during rotation of the shaft.

20 Claims, 26 Drawing Sheets

(56) References Cited

U.S. PATENT DOCUMENTS

| | | | | |
|---|---|---|---|---|
| 992,582 | A * | 5/1911 | Olson | F01C 21/0809<br>418/221 |
| 1,463,988 | A * | 8/1923 | Willerton | F01C 1/40<br>418/187 |
| 3,966,369 | A | 6/1976 | Garrison | |
| 5,733,113 | A | 3/1998 | Grupping | |
| 5,785,509 | A | 7/1998 | Harris et al. | |
| 6,499,976 | B1 | 12/2002 | McPhate et al. | |
| 7,172,039 | B2 | 2/2007 | Teale et al. | |
| 2012/0234603 | A1 | 9/2012 | Vail, III | |
| 2015/0068811 | A1 | 3/2015 | Marchand et al. | |
| 2015/0114721 | A1 | 4/2015 | Marchand et al. | |

* cited by examiner

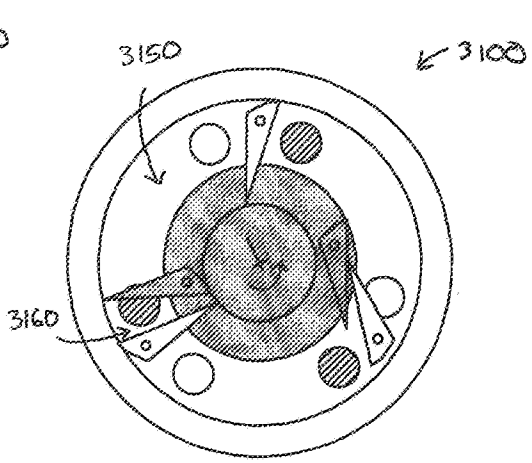
FIG. 18c
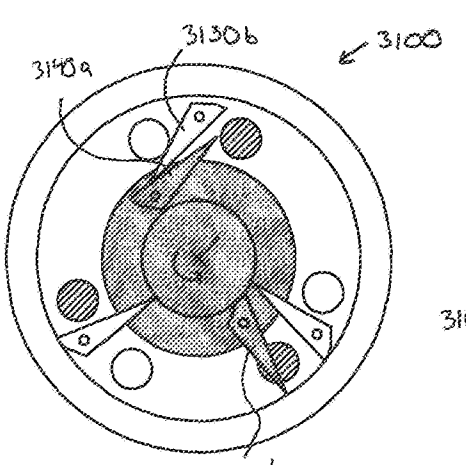
FIG. 18b
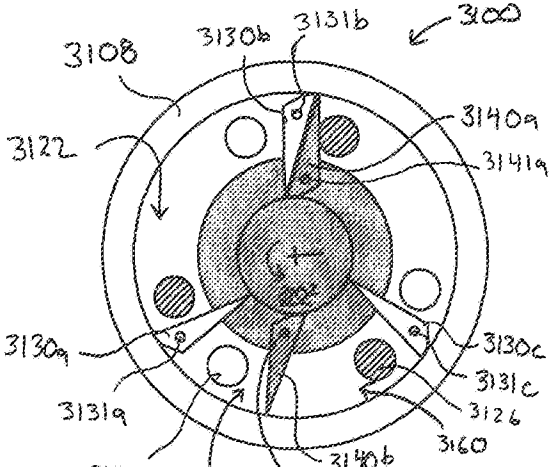
FIG. 18a
FIG. 18f
FIG. 18e
FIG. 18d

ROTARY DRIVE WITH PIVOTING STATOR AND ROTOR VANES

This application is a continuation of International Application Serial No. PCT/CA2017/050460, filed Apr. 13, 2017, which claims the benefit of Provisional Application Ser. No. 62/322,519, filed Apr. 14, 2016 and Provisional Application Ser. No. 62/409,161, filed Oct. 17, 2016, each of which is hereby incorporated herein by reference.

FIELD

The disclosure relates to rotary drives, and more specifically, to rotary motors and rotary pumps.

BACKGROUND

U.S. Pat. No. 3,966,369 (Garrison) discloses a positive displacement motor suitable for use in downhole drilling at the end of a drill string and driven by fluid, e.g., liquid mud, under high pressures. The motor has an arrangement of inlet and outlet ports in longitudinally extending circumferentially spaced rows for providing fluid at a substantially uniform pressure along substantially the length of the blades driving the motor so as to equalize the driving torque along the length of the rotor and avoid pressure differentials tending to twist the blade. A continuous ring isolates the adjacent rows of inlet and outlet ports.

U.S. Patent Application Publication No. 2015/0068811 (Marchand et al.) discloses a downhole motor rotary drive system including a housing, a rotor rotatably and coaxially disposed within the housing, and an annular space between the rotor and housing. The rotor includes first and second ends, a bore extending between the first and second ends, an inlet port extending from the bore to the annular space, and an outlet port extending from the annular space to the bore. A plurality of gates are disposed within the annular space, each configured to engage the rotor and the housing, and a plurality of lobes extend within the annular space such that the lobes and the gates divide the annular space into a plurality of chambers. A flow path is defined by the annular space between the inlet and outlet ports, and the rotor is configured to rotate relative to the housing when a fluid is circulated along the flow path.

U.S. Pat. No. 7,172,039 (Teale et al.) discloses a downhole tool for use in a wellbore. The downhole tool includes a housing having a shaped inner bore, a first end, and a second end. The downhole tool further includes a rotor having a plurality of extendable members, wherein the rotor is disposable in the shaped inner bore to form at least one chamber therebetween. Furthermore, the downhole tool includes a substantially axial fluid pathway through the chamber, wherein the fluid pathway includes at least one inlet proximate the first end and at least one outlet proximate the second end.

SUMMARY

According to some aspects, a rotary drive includes: a) a housing having a cylindrical casing extending along a drive axis between axially spaced apart first and second end caps; b) a shaft rotatably mounted within the housing and rotatable relative to the casing about the drive axis; c) an annular passage radially intermediate the shaft and the casing and bounded axially by the end caps; d) at least one stator vane extending axially across the passage, the at least one stator vane pivotable about a stator vane axis fixed relative to the casing between a stator vane closed position for inhibiting circumferential fluid flow in the passage across the stator vane, and a stator vane open position; and e) at least one rotor vane extending axially across the passage, the at least one rotor vane pivotable about a rotor vane axis fixed relative to the shaft between a rotor vane closed position for inhibiting circumferential fluid flow in the passage across the rotor vane, and a rotor vane open position. When in the closed positions, the stator and rotor vanes separate the passage into at least one circumferentially expanding chamber and at least one circumferentially collapsing chamber spaced circumferentially apart from the at least one expanding chamber, the at least one expanding chamber in fluid communication with at least one inlet in the housing for receiving fluid, and the at least one collapsing chamber in fluid communication with at least one outlet in the housing for evacuating fluid from the at least one collapsing chamber, and wherein when the rotor and stator vanes are in the open positions, the at least one rotor vane is movable circumferentially past the at least one stator vane during rotation of the shaft.

In some examples, the rotary drive includes a vane pivoting mechanism for pivoting at least one of the at least one stator vane and the at least one rotor vane in at least one direction between the open and closed positions when the shaft rotates through at least one predetermined angular position. In some examples, the vane pivoting mechanism urges the at least one stator vane toward the stator vane closed position when the shaft rotates through a stator vane first angular position. In some examples, the vane pivoting mechanism urges the at least one stator vane toward the stator vane open position when the shaft rotates through a stator vane second angular position. In some examples, the vane pivoting mechanism urges the at least one rotor vane toward the rotor vane closed position when the shaft rotates through a rotor vane first angular position. In some examples, the vane pivoting mechanism urges the at least one rotor vane toward the rotor vane open position when the shaft rotates through a rotor vane second angular position. In some examples, the rotor vane first position corresponds to the stator vane first position. In some examples, the rotor vane second position corresponds to the stator vane second position. In some examples the rotor vane first position and the stator vane first position correspond to a common first angular position of the shaft. In some examples, the rotor vane second position and the stator vane second position correspond to a common second angular position of the shaft.

In some examples, the rotor vane axis and the stator vane axis pass through the passage and extend parallel to the drive axis. The rotor vane axis and the stator vane axis may be radially offset from one another, with the rotor vane axis offset radially inwardly toward the shaft and the stator vane axis offset radially outwardly toward the casing. The rotor vane axis may rotate relative to the casing about the drive axis at a first radial distance from the drive axis, and the stator vane axis may rotate relative to the shaft about the drive axis at a second radial distance from the drive axis. The second radial distance may be greater than the first radial distance.

In some examples, the at least one rotor vane has a rotor vane height bounded by a rotor vane root edge and an opposed rotor vane tip edge. The rotor vane root edge may be proximate the shaft and the rotor vane tip edge may be proximate the casing when the at least one rotor vane is in the rotor vane closed position. The rotor vane axis may be intermediate the rotor vane tip edge and the rotor vane root edge.

In some examples, when the at least one rotor vane pivots from the rotor vane closed position toward the rotor vane open position, the rotor vane tip edge pivots about the rotor vane axis in a rotor vane first direction toward the shaft. When the at least one rotor vane pivots from the rotor vane open position toward the rotor vane closed position, the rotor vane tip edge may pivot about the rotor vane axis in a rotor vane second direction toward the casing. The rotor vane second direction may be opposite the rotor vane first direction. When the at least one rotor vane is in the rotor vane closed position, a rotor vane stop surface fixed to the rotor vane may abut a rotor abutment surface fixed relative to the shaft to inhibit further pivoting of the rotor vane in the rotor vane second direction.

In some examples, when the at least one rotor vane is in the rotor vane closed position, the rotor vane tip edge can be spaced radially apart from the casing by a rotor vane clearance gap for permitting interference free movement of the rotor vane tip edge relative to the casing.

In some examples, when the at least one rotor vane is in the rotor vane closed position, the rotor vane tip edge is in sliding contact with the casing.

In some examples, the at least one rotor vane has a rotor vane thickness bounded by a rotor vane trailing face and an opposed rotor vane leading face. The rotor vane trailing and leading faces may be bounded by the rotor vane root and tip edges. In some examples, when the at least one rotor vane is in the rotor vane closed position, the rotor vane trailing face extends radially across the passage and circumferentially bounds the at least one expanding chamber and the rotor vane leading face extends radially across the passage and circumferentially bounds the at least one collapsing chamber.

In some examples, when the at least one rotor vane is in the rotor vane open position, the rotor vane trailing face is directed generally radially inwardly toward the shaft, and the rotor vane leading face is directed generally radially outwardly toward the casing and is spaced radially apart from the casing by a radially outer passage gap. The radially outer passage gap may be sized for accommodating circumferential movement of the at least one rotor vane past the at least one stator vane when the rotor and stator vanes are in respective open positions.

In some examples, when the at least one rotor vane is in the rotor vane open position, the rotor vane trailing face is disposed radially intermediate the rotor vane axis and an outer surface of the shaft, and is spaced radially apart from the shaft by a rotor vane flow gap. The rotor vane flow gap may permit circumferential fluid flow in the passage across the at least one rotor vane.

In some examples, the at least one stator vane has a stator vane height bounded by a stator vane root edge and an opposed stator vane tip edge. The stator vane root edge may be proximate the casing and the stator vane tip edge may be proximate the shaft when the at least one stator vane is in the stator vane closed position. The stator vane axis may be intermediate the stator vane tip edge and the stator vane root edge.

In some examples, when the at least one stator vane pivots from the stator vane closed position toward the stator vane open position, the stator vane tip edge pivots about the stator vane axis in a stator vane first direction toward the casing. When the at least one stator vane pivots from the stator vane open position toward the stator vane closed position, the stator vane tip edge may pivot about the stator vane axis in a stator vane second direction toward the shaft. The stator vane second direction may be opposite the stator vane first direction. When the stator vane is in the stator vane closed position, a stator vane stop surface fixed to the stator vane may abut a stator abutment surface fixed relative to the casing to inhibit further pivoting of the stator vane in the stator vane second direction.

In some examples, when the at least one stator vane is in the stator vane closed position, the stator vane tip edge can be spaced radially apart from the shaft by a stator vane clearance gap for permitting interference free rotation of the shaft relative to the stator vane tip edge.

In some examples, when the at least one stator vane is in the stator vane closed position, the stator vane tip edge is in sliding contact with the shaft.

In some examples, the at least one stator vane has a stator vane thickness bounded by a stator vane trailing face and an opposed stator vane leading face. The stator vane trailing and leading faces may be bounded by the stator vane root and tip edges. In some examples, when the at least one stator vane is in the stator vane closed position, the stator vane leading face extends radially across the passage and circumferentially bounds the at least one expanding chamber and the stator vane trailing face extends radially across the passage and circumferentially bounds the at least one collapsing chamber.

In some examples, when the at least one stator vane is in the stator vane open position, the stator vane leading face is directed generally radially outwardly toward the casing, and the stator vane trailing face is directed generally radially inwardly toward the shaft and spaced radially apart from the shaft by a radially inner passage gap. The radially inner passage gap may be sized for accommodating circumferential movement of the at least one rotor vane past the at least one stator vane when the rotor and stator vanes are in respective open positions.

In some examples, when in respective open positions, the at least one rotor vane and the at least one stator vane are spaced radially apart by an intermediate clearance gap for permitting interference free movement of the at least one rotor vane past the at least one stator vane during rotation of the shaft. In some examples the intermediate clearance gap permits circumferential fluid flow past the at least one rotor vane and the at least one stator vane.

In some examples, when the at least one stator vane is in the stator vane open position, the stator vane leading face is disposed radially intermediate the stator vane axis and an inner surface of the casing, and is spaced radially apart from the casing by a stator vane flow gap. The stator vane flow gap may permit circumferential fluid flow in the passage across the at least one stator vane.

In some examples, the at least one inlet extends axially through the first end cap. In some examples, the at least one outlet extends axially through the second end cap.

In some examples, at least one of the at least one inlet and the at least one outlet extends radially through the casing.

In some examples, the shaft includes an internal shaft conduit for conducting fluid, and at least one of the at least one inlet and the at least one outlet extends radially through the shaft for conducting fluid between the passage and the shaft conduit.

In some examples, the first end cap includes a first stator disc fixed relative to the casing, and the second end cap includes a second stator disc fixed relative to the casing. In some examples the first end cap includes a first rotor disc fixed to rotate with the shaft, and the second end cap includes a second rotor disc fixed to rotate with the shaft. In some examples, the first rotor disc is radially inward of the first stator disc and the second rotor disc is radially inward of the second stator disc. In some examples, the first stator disc axially overlaps the first rotor disc and the second stator disc axially overlaps the second rotor disc.

In some examples, the at least one inlet extends axially through and is fixed relative to the first stator disc. In some examples, the at least one inlet extends axially through and is fixed relative to the first rotor disc. In some examples, the at least one outlet extends axially through and is fixed relative to the second stator disc. In some examples, the at least one outlet extends axially through and is fixed relative to the second rotor disc.

In some examples, the at least one rotor vane extends axially between a first end pivotally supported by the first rotor disc and a second end pivotally supported by the second rotor disc for pivoting about the rotor vane axis. In some examples, the at least one rotor vane includes a rotor vane first pin projecting axially from a first axial endface of the at least one rotor vane, and a rotor vane second pin projecting axially from an opposed second axial endface of the at least one rotor vane. Each of the rotor vane first and second pins may be received in a respective aperture in the first and second rotor discs for pivotally supporting the at least one rotor vane.

In some examples, the at least one stator vane extends axially between a first end pivotally supported by the first stator disc and a second end pivotally supported by the second stator disc for pivoting about the stator vane axis. In some examples, the at least one stator vane includes a stator vane first pin projecting axially from a first axial endface of the at least one stator vane, and a stator vane second pin projecting axially from an opposed second axial endface of the at least one stator vane. Each of the stator vane first and second pins may be received in a respective aperture in the first and second stator discs for pivotally supporting the at least one stator vane.

In some examples, the at least one rotor vane comprises a plurality of rotor vanes pivotable about respective rotor vane axes. The rotor vane axes may be spaced equally apart about the drive axis. The at least one stator vane may comprise a plurality of stator vanes pivotable about respective stator vane axes. The stator vane axes may be spaced equally apart about the drive axis.

In some examples, the plurality of rotor vanes includes a number of rotor vanes and the plurality of stator vanes includes a number of stator vanes. In some examples, the number of stator vanes may be equal to the number of rotor vanes. The number of stator vanes may be two, and the number of rotor vanes may be two. In some examples, the number of stator vanes may be greater than the number of rotor vanes. The number of stator vanes may be one greater than the number of rotor vanes. The number of stator vanes may be three, and the number of rotor vanes may be two.

According to some aspects, a rotary motor includes: (a) a housing having a cylindrical casing extending along a drive axis between axially spaced apart first and second end caps; (b) a shaft rotatably mounted within the housing and rotatable relative to the casing about the drive axis; (c) an annular passage radially intermediate the shaft and the casing and bounded axially by the end caps; (d) at least one stator vane extending axially across the passage, the at least one stator vane pivotable about a stator vane axis fixed relative to the casing between a stator vane closed position for inhibiting circumferential fluid flow in the passage across the stator vane, and a stator vane open position; and (e) at least one rotor vane extending axially across the passage, the at least one rotor vane pivotable about a rotor vane axis fixed relative to the shaft between a rotor vane closed position for inhibiting circumferential fluid flow in the passage across the rotor vane, and a rotor vane open position. When in the closed positions, the stator and rotor vanes separate the passage into at least one circumferentially expanding chamber and at least one circumferentially collapsing chamber spaced circumferentially apart from the at least one expanding chamber. The at least one expanding chamber is in fluid communication with at least one inlet in the housing for receiving pressurized fluid. The pressurized fluid can bear against a trailing face of the at least one rotor vane to urge rotation of the shaft in a power direction. The at least one collapsing chamber is in fluid communication with at least one outlet in the housing for evacuating fluid from the at least one collapsing chamber. When the rotor and stator vanes are in the open positions, the at least one rotor vane is movable circumferentially past the at least one stator vane during rotation of the shaft in the power direction.

According to some aspects of the teaching disclosed herein, a rotary pump includes: (a) a housing having a cylindrical casing extending along a drive axis between axially spaced apart first and second end caps; (b) a shaft rotatably mounted within the housing and rotatable relative to the casing about the drive axis; (c) an annular passage radially intermediate the shaft and the casing and bounded axially by the end caps; (d) at least one stator vane extending axially across the passage, the at least one stator vane pivotable about a stator vane axis fixed relative to the casing between a stator vane closed position for inhibiting circumferential fluid flow in the passage across the stator vane, and a stator vane open position; and (e) at least one rotor vane extending axially across the passage, the at least one rotor vane pivotable about a rotor vane axis fixed relative to the shaft between a rotor vane closed position for inhibiting circumferential fluid flow in the passage across the rotor vane, and a rotor vane open position. When in the closed positions, the stator and rotor vanes separate the passage into at least one circumferentially expanding chamber and at least one circumferentially collapsing chamber spaced circumferentially apart from the at least one expanding chamber. The at least one expanding chamber is in fluid communication with at least one inlet in the housing for drawing fluid into the at least one expanding chamber during rotation of the shaft in a power direction. The at least one collapsing chamber is in fluid communication with at least one outlet in the housing for discharging pressurized fluid from the at least one collapsing chamber during rotation of the shaft in the power direction. When the rotor and stator vanes are in the open positions, the at least one rotor vane is movable circumferentially past the at least one stator vane during rotation of the shaft in the power direction.

In some examples, the rotary pump includes a vane pivoting mechanism for pivoting the at least one stator vane and the at least one rotor vane from respective closed positions to respective open positions when the shaft rotates through at least one predetermined angular position. In some examples, the vane pivoting mechanism urges at least one of the at least one stator vane and the at least one rotor vane to pivot from respective open positions back to respective closed positions when the at least one rotor vane passes the at least one stator vane.

In some examples, the at least one inlet includes a one-way fluid check valve for permitting flow of fluid into the at least one expanding chamber through the at least one inlet and blocking flow of fluid out from the at least one expanding chamber through the at least one inlet. In some examples, the at least one outlet includes a one-way fluid check valve for permitting flow of fluid out from the at least one collapsing chamber through the at least one outlet and blocking flow of fluid into the at least one collapsing chamber through the at least one outlet.

According to some aspects, a rotary drive includes a housing; a shaft rotatably mounted within the housing and rotatable about a drive axis; a fluid passage internal the housing and extending circumferentially about the shaft; at least one stator vane within the passage, the at least one stator vane movable between a stator vane open position and a stator vane closed position, and when in the stator vane closed position, the at least one stator vane presents a stator vane high-pressure face extending radially across the passage and a circumferentially opposite stator vane low-pressure face extending radially across the passage; and at least one rotor vane within the passage and fixed to rotate with the shaft relative to the at least one stator vane, the at least one rotor vane movable between a rotor vane open position and a rotor vane closed position, and when in the rotor vane closed position, the at least one rotor vane presents a rotor vane high-pressure face extending radially across the passage and a circumferentially opposite rotor vane low-pressure face extending radially across the passage. When in respective closed positions, the rotor and stator vanes separate the passage into at least one high pressure chamber bounded circumferentially by the stator vane and rotor vane high-pressure faces, and at least one low pressure chamber bounded circumferentially by the stator vane and rotor vane low-pressure faces, the at least one high pressure chamber in fluid communication with at least one first flow port in the housing, the first flow port being one of an inlet and an outlet, and the at least one low pressure chamber in fluid communication with at least one second flow port in the housing, the second flow port being the other one of the inlet and the outlet. When in respective open positions, the stator vane and the rotor vane are retracted relative to one another for permitting the rotor vane to move circumferentially past the stator vane during rotation of the shaft.

In some examples, the rotary drive comprises a rotary motor for driving rotation of the shaft in a power direction. In some examples, the at least one high pressure chamber comprises at least one expanding chamber and the first flow port is the inlet, and the at least one low pressure chamber comprises at least one collapsing chamber and the second flow port is the outlet. The rotor vane high-pressure face can comprise a rotor vane trailing face of the at least one rotor vane. The rotor vane low-pressure face can comprise a rotor vane leading face of the at least one rotor vane. The stator vane high-pressure face can comprise a stator vane leading face of the at least one stator vane. The stator vane low-pressure face can comprise a stator vane trailing face of the at least one stator vane.

In some examples, the rotary drive comprises a rotary pump for discharging pressurized fluid. In some examples, the at least one high pressure chamber comprises at least one collapsing chamber and the first flow port is the outlet, and the at least one low pressure chamber comprises at least one expanding chamber and the second flow port is the inlet. The rotor vane high-pressure face can comprise a rotor vane leading face of the at least one rotor vane. The rotor vane low-pressure face can comprise a rotor vane trailing face of the at least one rotor vane. The stator vane high-pressure face can comprise a stator vane trailing face of the at least one stator vane. The stator vane low-pressure face can comprise a stator vane leading face of the at least one stator vane.

According to some aspects, a rotary drive includes a housing; a shaft rotatably mounted within the housing and rotatable about a drive axis; a passage internal the housing and extending circumferentially about the shaft; and at least one stator closure member within the passage and movable between a stator closure member closed position, in which circumferential fluid flow in the passage across the stator closure member in a circumferential first direction is blocked, and a stator closure member open position. The rotary drive further includes at least one rotor closure member within the passage and fixed to rotate with the shaft relative to the stator closure member. The at least one rotor closure member is movable between a rotor closure member closed position, in which circumferential fluid flow in the passage across the at least one rotor closure member in a second circumferential direction opposite the first direction is blocked, and a rotor closure member open position. When in respective closed positions, the stator and rotor closure members separate the passage into at least one circumferentially expanding chamber in fluid communication with at least one fluid inlet in the housing for conducting fluid into the at least one expanding chamber during rotation of the shaft in a power direction, and at least one circumferentially collapsing chamber in fluid communication with at least one outlet in the housing for evacuating fluid from the at least one collapsing chamber during rotation of the shaft in a power direction. When in respective open positions, the at least one rotor closure member is movable circumferentially past the at least one stator closure member during rotation of the shaft in the power direction.

In some examples, the at least one stator closure member comprises at least one stator vane and the at least one rotor closure member comprises at least one rotor vane.

The following summary is intended to introduce the reader to various aspects of the applicant's teaching, but not to define any invention.

BRIEF DESCRIPTION OF THE DRAWINGS

The drawings included herewith are for illustrating various examples of articles, methods, and apparatuses of the present specification and are not intended to limit the scope of what is taught in any way. In the drawings:

FIG. 18*a* is a partially schematic cross-sectional view of the motor of FIG. 15, shown in one condition;

FIGS. 18*b*-18*f* are views of the same structure as FIG. 18*a*, showing a sequence of rotation from a first position in FIG. 18*a*, through second-sixth positions in FIGS. 18*b*-18*f*, respectively;

DETAILED DESCRIPTION

Various apparatuses or processes will be described below to provide an example of an embodiment of the claimed subject matter. No embodiment described below limits any claim and any claim may cover processes or apparatuses that differ from those described below. The claims are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any subject matter described below and for which an exclusive right is not granted by issuance of this patent application may be the subject matter of another protective instrument, for example, a continuing patent application, and the applicants, inventors or owners do not intend to abandon, disclaim, or dedicate to the public any such subject matter by its disclosure in this document.

According to some aspects of the teaching disclosed herein, design improvements can advantageously be made to rotary drives having pivoting vanes that transfer power between the vanes and a fluid passing through the rotary drive. The rotary drive may be a motor or a pump.

Figure 1:
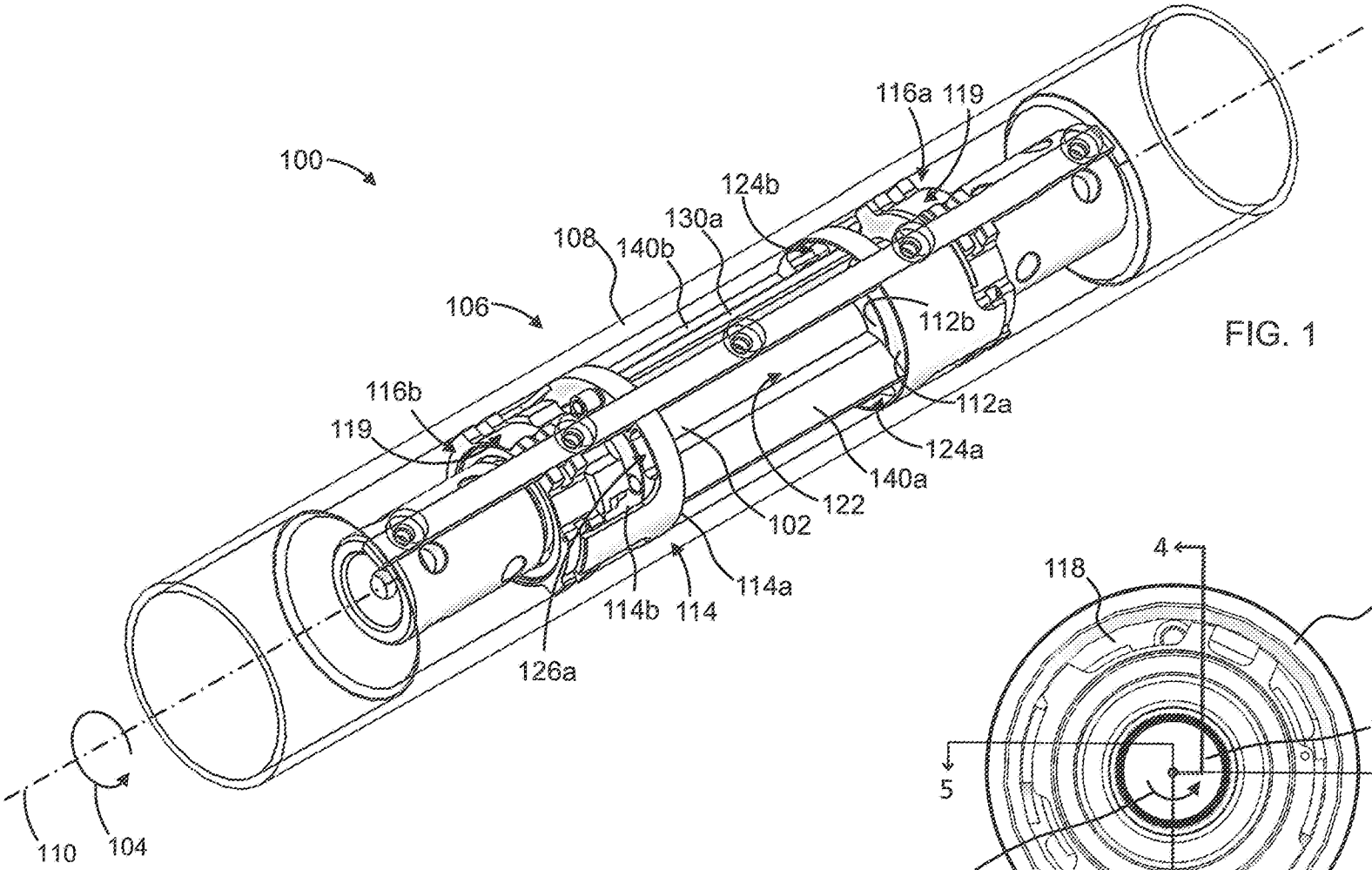
FIG. 1 is a perspective view of an example rotary motor taken from a downstream end of the motor with inner elements visible through outer elements depicted in outline.
Figure 2:
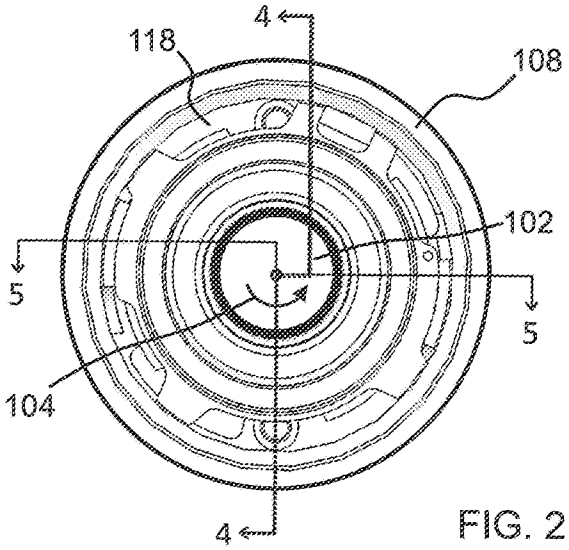
FIG. 2 is an end view of the downstream end of the motor of FIG. 1.

Referring to FIG. 1, an example fluid-driven rotary motor 100 is illustrated. The motor 100 is configured to rotate a shaft 102 in a power direction 104. The rotary motor 100 includes a housing 106 having a cylindrical casing 108 (shown transparent in FIG. 1) extending along a housing axis 110 (also referred to as drive axis 110) between axially spaced apart first and second end caps 112, 114 (also referred to as upstream and downstream end caps 112, 114, respectively). The shaft 102 is rotatably mounted within the housing 106 and is rotatable relative to the casing 108 about the drive axis 110.

In the example illustrated, the first end cap 112 includes a first stator disc 112*a* (also referred to as upstream stator disc 112*a*) fixed relative to the casing 108, and the second end cap 114 includes a second stator disc 114*a* (also referred to as downstream stator disc 114*a*) fixed relative to the casing 108. In the example illustrated, the first and second stator discs 112*a*, 114*a* are fixed relative to the casing 108 by a key. The key is bolted to the casing 108 and extends into notches provided in the outer surfaces of the first and second stator discs 112*a*, 114*a*. In the example illustrated, the first end cap 112 includes a first rotor disc 112*b* (also referred to as upstream rotor disc 112*b*) that is fixed to rotate with the shaft 102 about the drive axis 110, and the second end cap 114 includes a second rotor disc 114*b* (also referred to as downstream rotor disc 114*b*) that is fixed to rotate with the shaft 102 about the drive axis 110. In the example illustrated, the first rotor disc 112*b* is radially inward of the first stator disc 112*a*, and the second rotor disc 114*b* is radially inward of the second stator disc 114*a*. In the example illustrated, the first stator disc 112*a* axially overlaps the first rotor disc 112*b*, and the second stator disc 114*a* axially overlaps the second rotor disc 114*b*.

In the example illustrated, the shaft 102 is rotatably supported by a pair of bearing assemblies 116*a*, 116*b* mounted to the housing 106. The first bearing assembly 116*a* includes a first bearing housing 118*a* mounted to the housing 106 outboard of the first end cap 112 and fixed relative to the casing 108, and the second bearing assembly 116*b* includes a second bearing housing 118*b* mounted to the housing 106 outboard of the second end cap 114 and fixed relative to the casing 108. Each bearing housing 118*a*, 118*b* houses a respective bearing 120*a*, 120*b* (see also FIG. 3) rotatably supporting the shaft 102. Each bearing housing 118*a*, 118*b* includes a plurality of fluid flow passages 119. In the example illustrated, the fluid flow passages 119 are radially intermediate outer surfaces of the bearing housings 118*a*, 118*b* and inner surfaces of the casing 108. The bearing assemblies 116*a*, 116*b* can also axially support the end caps (and the vanes extending between them) in position along the length of the shaft 102.

In the example illustrated, the motor 100 includes an annular passage 122 within the housing 106. The annular passage 122 is radially intermediate the shaft 102 and the casing 108 (see also FIG. 6*a*), and is bounded axially by the first and second end caps 112, 114 (see also FIG. 4).

In the example illustrated, the motor 100 includes at least one inlet in the housing 106 for conducting fluid into the annular passage 122, and at least one outlet in the housing 106 for evacuating fluid from the annular passage 122. In the example illustrated, the motor 100 includes two inlets 124*a*, 124*b* in the housing 106 for conducting fluid into the annular passage 122, and two outlets 126*a*, 126*b* in the housing 106 for evacuating fluid from the annular passage 122 (see also FIG. 3). The inlets 124*a*, 124*b* extend axially through the first end cap 112, and the outlets 126*a*, 126*b* extend axially through the second end cap 114. In the example illustrated, the inlets 124*a*, 124*b* extend axially through and are fixed relative to the first stator disc 112*a*, and the outlets 126*a*, 126*b* extend axially through and are fixed relative to the second stator disc 114*a*. The inlets 124*a*, 124*b* and the outlets 126*a*, 126 are spaced circumferentially apart, with the outlets 126*a*, 126*b* circumferentially interposed between the inlets 124*a*, 124*b*.

Figure 3:
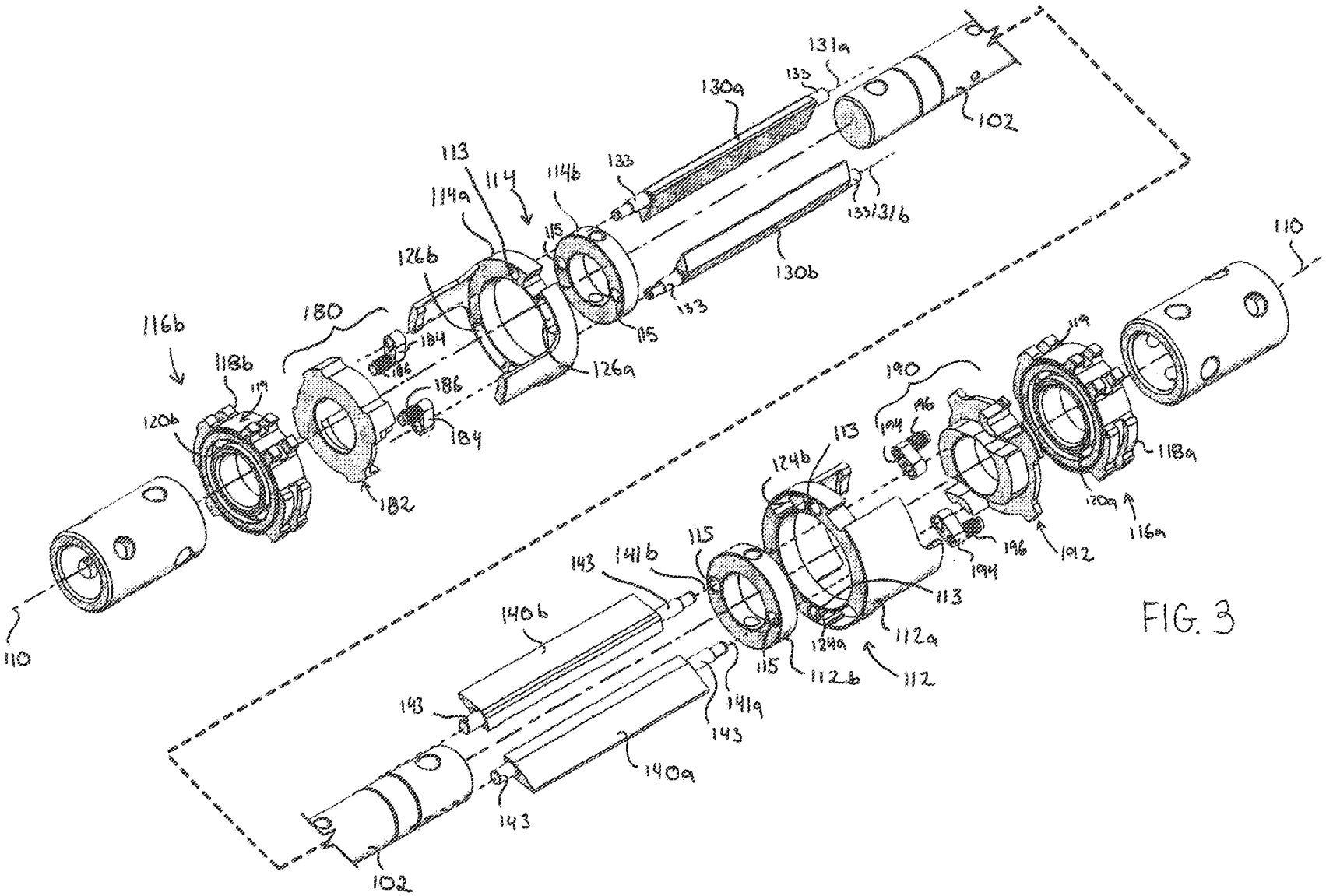
FIG. 3 is an exploded view of portions of the motor of FIG. 1.
Figure 4:
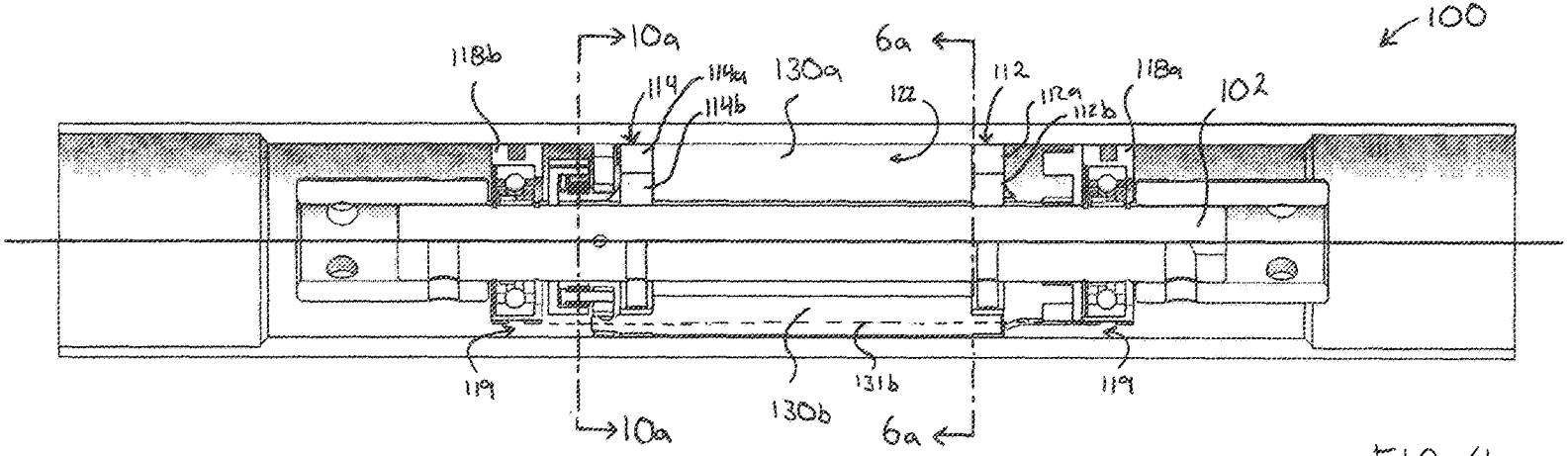
FIG. 4 is a cross-sectional view of the motor of FIG. 1 taken along line 4-4 of FIG. 2.
Figure 6B:
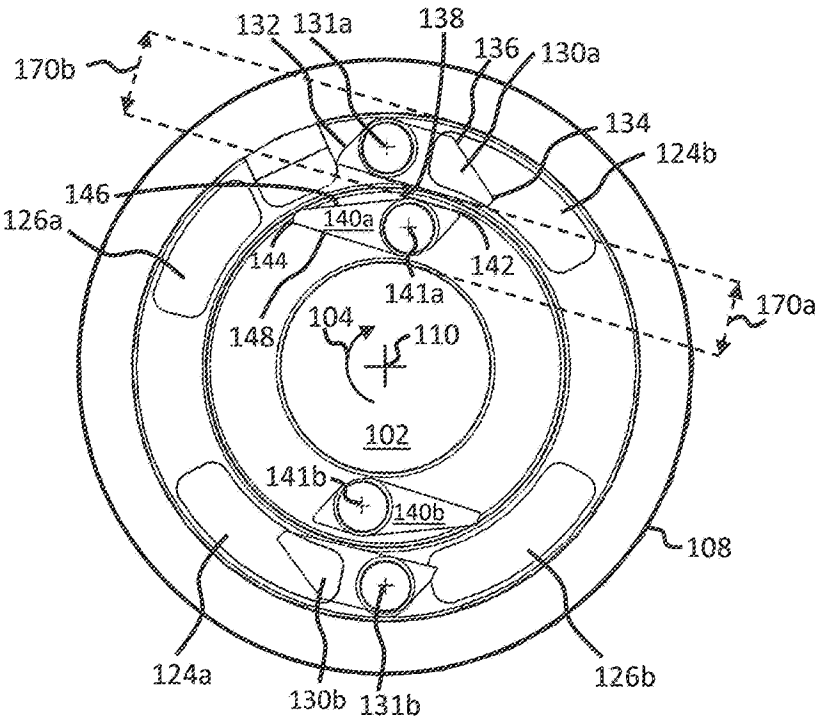
FIG. 6*b* is the same view of the motor of FIG. 6*a* but showing the motor in another condition.
Figure 6A:
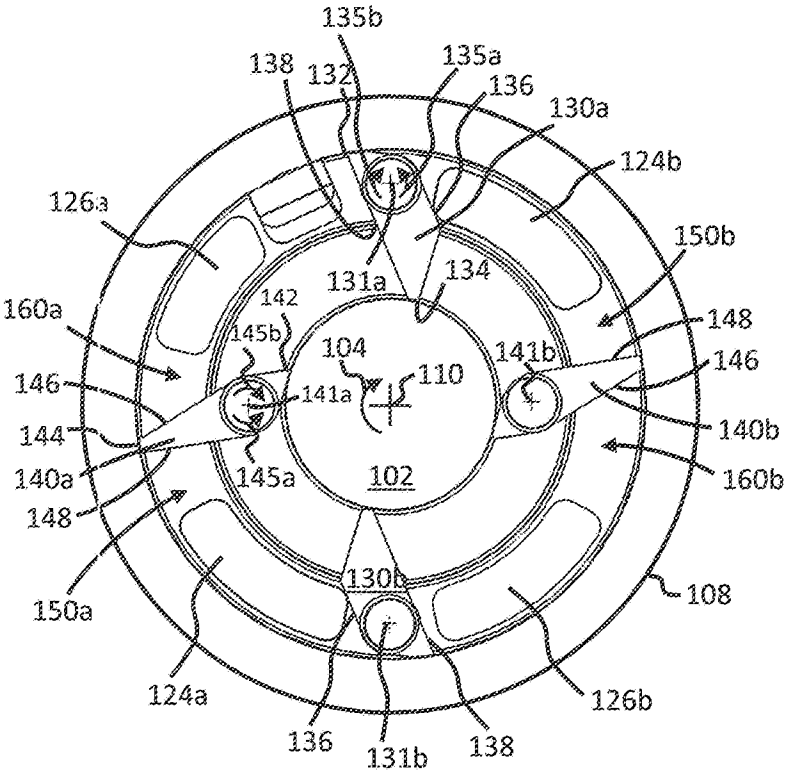
FIG. 6*a* is a partially schematic cross-sectional view of the motor of FIG. 1 taken along line 6*a*-6*a* of FIG. 4, with the motor shown in one condition.

Referring to FIG. 4, in the example illustrated, the motor 100 includes two stator vanes 130*a*, 130*b* extending axially across the passage 122. Referring to FIG. 3, each stator vane 130*a*, 130*b* is pivotable about a respective stator vane axis 131*a*, 131*b* fixed relative to the casing 108 (see also FIG. 6*a*). The stator vane axes 131*a*, 131*b* pass through the passage 122 and extend parallel to the drive axis 110, and in the example illustrated, are spaced equally apart about the drive axis 110. Referring to FIGS. 6*a* and 6*b*, each stator vane 130*a*, 130*b* is pivotable about its stator vane axis 131*a*, 131*b* between a stator vane closed position (shown in FIG. 6*a*) for inhibiting circumferential fluid flow in the passage 122 across the respective stator vane 130*a*, 130*b*, and a stator vane open position (shown in FIG. 6*b*).

Figure 7A:
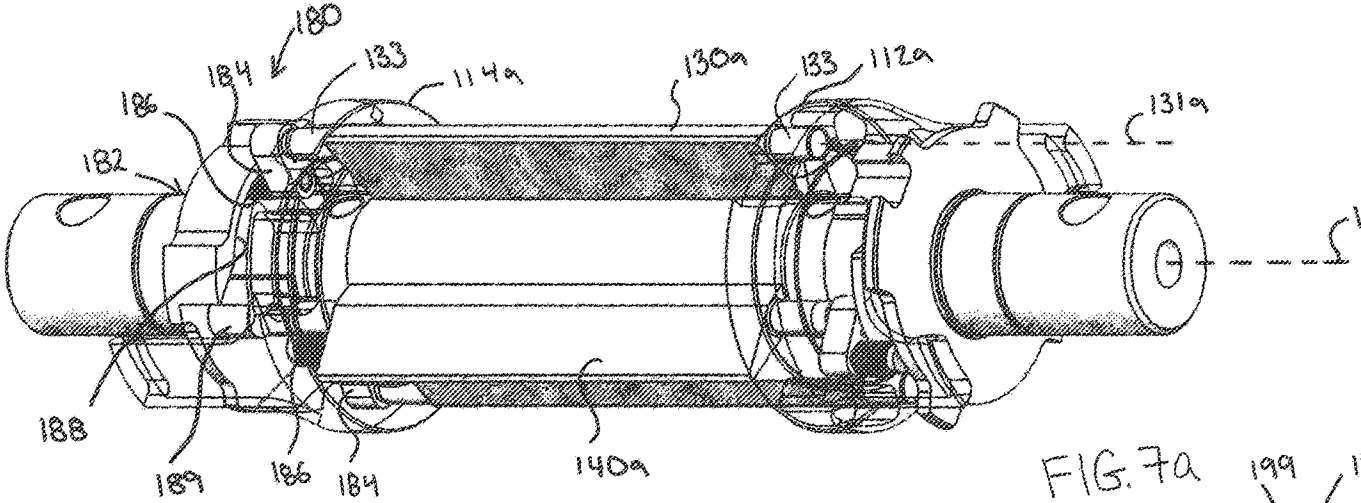
FIG. 7*a* is a perspective view of portions of the motor of FIG. 1 taken from an upstream end of the motor.

The stator vanes 130*a*, 130*b* are similar to one another, and for simplicity, only the stator vane 130*a* will be described in detail. Referring to FIG. 7*a*, in the example illustrated, the stator vane 130*a* is pivotally supported by the first and second stator discs 112*a*, 114*a* (shown transparent in FIG. 7*a*) for pivoting about the stator vane axis 131*a*. The stator vane 130*a* includes stator vane pins 133 projecting axially from axial endfaces of the stator vane 130*a* along the stator vane axis 131*a*. The stator vane pins 133 are received in respective stator vane apertures 113 (see FIG. 3) in the first and second stator discs 112*a*, 114*a* for pivotally supporting the stator vane 130*a*.

Referring to FIG. 6*a*, the stator vane 130*a* has a stator vane height bounded by a stator vane root edge 132 and an opposed stator vane tip edge 134. When the stator vane 130*a* is in the stator vane closed position, the stator vane root edge 132 is proximate the casing 108 and the stator vane tip edge 134 is proximate the shaft 102. In the example illustrated, the stator vane axis 131*a* is intermediate the stator vane tip edge 134 and the stator vane root edge 132, and is nearer the stator vane root edge 132 in the example illustrated.

In some examples, the stator vane tip edge 134 can comprise a stator vane tip seal surface for engaging a rotor engagement surface fixed relative to the shaft 102 in sealed sliding fit when the stator vane 130 is in the closed position. In the example illustrated, the rotor engagement surface comprises a portion of an outer surface of the shaft 102. The stator vane seal tip surface can comprise a deformable material affixed to the stator vane.

Referring to FIGS. 6*a* and 6*b*, in the example illustrated, when the stator vane 130*a* pivots from the stator vane closed position (FIG. 6*a*) toward the stator vane open position (FIG. 6*b*), the stator vane tip edge 134 pivots about the stator vane axis 131*a* in a stator vane first direction 135*a* toward the casing 108. When the stator vane 130*a* pivots from the stator vane open position toward the stator vane closed position, the stator vane tip edge 134 pivots about the stator vane axis 131*a* in a stator vane second direction 135*a* toward the shaft 102. The stator vane second direction 135*b* is opposite the stator vane first direction 135*a*. When the stator vane 130*a* is in the stator vane closed position, a stator vane stop surface fixed to the stator vane 130 abuts a stator abutment surface fixed relative to the casing 108 to inhibit further pivoting of the stator vane 130*a* in the stator vane second direction 135*b*. In the example illustrated, the stator vane stop surface comprises at least a portion of the stator vane root edge 132, and the stator abutment surface comprises a portion of an inner surface of the casing 108.

In the example illustrated, the stator vane 130*a* has a stator vane thickness bounded by a stator vane leading face 136 and an opposed stator vane trailing face 138. The stator vane leading and trailing faces 136, 138 are bounded by the stator vane root and tip edges 132, 134. Referring to FIG. 6*a*, when the stator vane 130*a* is in the stator vane closed position, the stator vane leading face 136 extends radially across the passage 122 and is directed generally toward the power direction 104, and the trailing face 138 extends radially across the passage 122 and is directed generally toward a reverse direction opposite the power direction 104.

Referring to FIG. 6*b*, when the stator vane 130*a* is in the stator vane open position, the stator vane leading face 136 is directed generally radially outwardly toward the casing 108, and the stator vane trailing face 138 is directed generally radially inwardly toward the shaft 102.

Figure 5:
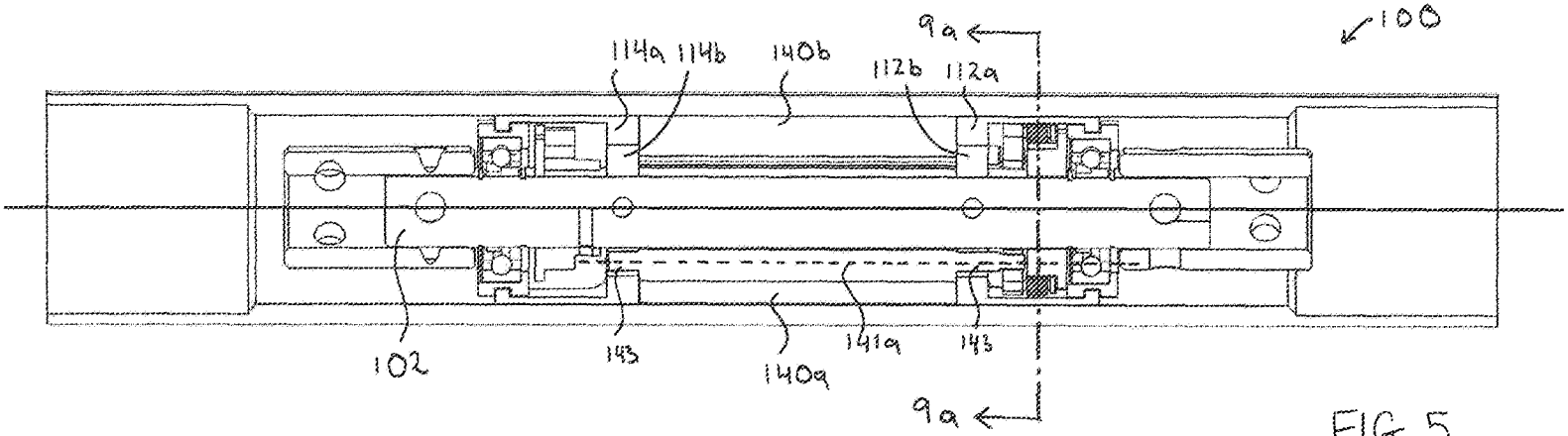
FIG. 5 is a cross-sectional view of the motor of FIG. 1 taken along line 5-5 of FIG. 2.

Referring to FIG. 5, in the example illustrated, the motor 100 includes two rotor vanes 140*a*, 140*b* extending axially across the passage 122. Referring to FIG. 3, each rotor vane 140*a*, 140*b* is pivotable about a respective rotor vane axis 141*a*, 141*b* fixed relative to the shaft 102 (see also FIG. 6*a*). The rotor vane axes 141*a*, 141*b* pass through the passage 122 and extend parallel to the drive axis 110, and in the example illustrated, are spaced equally apart about the drive axis 110. Referring to FIGS. 6*a* and 6*b*, each rotor vane 140*a*, 140*b* is pivotable about its rotor vane axis 141*a*, 141*b* between a rotor vane closed position (shown in FIG. 6*a*) for inhibiting circumferential fluid flow in the passage 122 across the respective rotor vane 140*a*, 140*b*, and a rotor vane open position (shown in FIG. 6*b*).

The rotor vanes 140*a*, 140*b* are similar to one another, and for simplicity, only the rotor vane 140*a* will be described in detail. Referring to FIG. 5, in the example illustrated, the rotor vane 140*a* is pivotally supported by the first and second rotor discs 112*b*, 114*b* for pivoting about the rotor vane axis 141*a* (see also FIG. 7*b*). The rotor vane 140*a* includes rotor vane pins 143 projecting axially from axial endfaces of the rotor vane 140*a* along the rotor vane axis 141*a*. The rotor vane pins 143 are received in respective rotor vane apertures 115 in the first and second rotor discs 112*b*, 114*b* for pivotally supporting the rotor vane 140*a*.

Referring to FIG. 6*a*, the rotor vane 140*a* has a rotor vane height bounded by a rotor vane root edge 142 and an opposed rotor vane tip edge 144. When the rotor vane 140*a* is in the rotor vane closed position (FIG. 6*a*), the rotor vane root edge 142 is proximate the shaft 102 and the rotor vane tip edge 144 is proximate the casing 108. The rotor vane axis 141*a* is intermediate the rotor vane tip edge 144 and the rotor vane root edge 142, and is nearer the rotor vane root edge 142 in the example illustrated.

Referring to FIGS. 6*a* and 6*b*, in the example illustrated, when the rotor vane 140*a* pivots from the rotor vane closed position (FIG. 6*a*) toward the rotor vane open position (FIG. 6*b*), the rotor vane tip edge 144 pivots about the rotor vane axis 141*a* in a rotor vane first direction 145*a* toward the shaft 102. When the rotor vane 140*a* pivots from the rotor vane open position toward the rotor vane closed position, the rotor vane tip edge 144 pivots about the rotor vane axis 141*a* in a rotor vane second direction 145*b* toward the casing 108. The rotor vane second direction 145*b* is opposite the rotor vane first direction 145*a*. In the example illustrated the rotor vane first direction 145*a* corresponds to the stator vane first direction 135*a*, and the rotor vane second direction 145*b* corresponds to the stator vane second direction 135*b*. When the rotor vane 140*a* is in the rotor vane closed position, a rotor vane stop surface fixed to the rotor vane 140 abuts a rotor abutment surface fixed relative to the shaft 102 to inhibit further pivoting of the rotor vane 140*a* in the rotor vane second direction 145*b*. In the example illustrated, the rotor vane stop surface comprises at least a portion of the rotor vane root edge 142, and the rotor abutment surface comprises a portion of the outer surface of the shaft 102.

In the example illustrated, the rotor vane 140*a* has a rotor vane thickness bounded by a rotor vane leading face 146 and an opposed rotor vane trailing face 148. The rotor vane trailing and leading faces 146, 148 are bounded by the rotor vane root and tip edges 142, 144. When the rotor vane 140*a* is in the rotor vane closed position, the rotor vane leading face 146 extends radially across the passage 122 and is directed generally toward the power direction 104, and the rotor vane trailing face 148 extends radially across the passage 122 and is directed generally toward the reverse direction. Referring to FIG. 6*b*, when the rotor vane 140*a* is in the rotor vane open position, the rotor vane trailing face 148 is directed generally radially inwardly toward the shaft 102, and the rotor vane leading face 146 is directed generally radially outwardly toward the casing 108.

In some examples, the rotor vane tip edge 144 can comprise a rotor vane tip seal surface for engaging a stator engagement surface fixed relative to the casing 108 in sealed sliding fit when the rotor vane 140 is in the closed position. The stator engagement surface can comprise at least a portion of the inner surface of the casing 108. The rotor vane seal tip surface can comprise a deformable material affixed to the rotor vane.

Referring to FIG. 6*a*, when in respective closed positions, the stator vanes 130*a*, 130*b* and the rotor vanes 140*a*, 140*b* separate the passage 122 into two circumferentially expanding chambers 150*a*, 150*b*, and two circumferentially collapsing chambers 160*a*, 160*b* that are spaced circumferentially apart from the expanding chambers 150*a*, 150*b*. In the example illustrated, the collapsing chambers 160*a*, 160*b* are interposed between the expanding chambers 150*a*, 150*b*. In the example illustrated, the expanding chambers 150*a*, 150*b* are bounded circumferentially by the trailing faces 148 of the rotor vanes 140*a*, 140*b* and the leading faces 136 of the stator vanes 130*a*, 130*b*. The collapsing chambers 160*a*, 160*b* are bounded circumferentially by the leading faces 146 of the rotor vanes 140*a*, 140*b* and the trailing faces 138 of the stator vanes 130*a*, 130*b*. Each of the expanding and collapsing chambers 150*a*, 150*b*, 160*a*, 160*b* are bounded axially by inner surfaces of the end caps 112, 114, and radially by an outer surface of the shaft 102 and an inner surface of the casing 108.

In the example illustrated, the expanding chambers 150*a*, 150*b* are in fluid communication with the inlets 124*a*, 124*b* for receiving pressurized fluid. The pressurized fluid can bear against the trailing faces 148 of the rotor vanes 140*a*, 140*b* to urge rotation of the shaft 102 in the power direction 104. The collapsing chambers 160*a*, 160*b* are in fluid communication with the outlets 126*a*, 126*b* for evacuating fluid from the collapsing chambers 160*a*, 160*b* during rotation of the shaft 102 in the power direction 104. As the shaft 102 rotates in the power direction 104, the leading faces 146 of the rotor vanes 140*a*, 140*b* bear against fluid in the collapsing chambers 160*a*, 160*b* to urge evacuation of the fluid via the outlets 126*a*, 126*b*.

Referring to FIG. 6*b*, when the rotor vanes 140*a*, 140*b* and the stator vanes 130*a*, 130*b* are in respective open positions, the rotor vanes 140*a*, 140*b* can move circumferentially past stator vanes 130*a*, 130*b* during rotation of the shaft 102. In the example illustrated, the rotor vane axes 141*a*, 141*b* are radially offset from the stator vane axes 131*a*, 131*b*. In the example illustrated, the rotor vane axes 141*a*, 141*b* are offset radially inwardly toward the shaft 102 and the stator vane axes 131*a*, 131*b* are offset radially outwardly toward the casing 108. Referring to FIG. 6*b*, when the rotor vanes 140*a*, 140*b* and the stator vanes 130*a*, 130*b* are in respective open positions, the stator vane trailing faces 138 are spaced radially apart from the shaft 102 by a radially inner passage gap 170*a*, and the rotor vane leading faces 146 are spaced radially apart from the casing 108 by a radially outer passage gap 170*b*. The radially inner and radially outer passage gaps 170*a*, 170*b* are sized to accommodate circumferential movement of the rotor vanes 140*a*,

140*b* past the stator vanes 130*a*, 130*b* when the rotor and stator vanes are in respective open positions.

Referring to FIG. 6*b*, in the example illustrated, when the rotor and stator vanes 130, 140 are in respective open positions, the inlets 124*a*, 124*b* are in fluid communication with the outlets 126*a*, 126*b*, and the motor may generate insufficient torque for rotating the shaft 102 in the power direction 104 to move the rotor vanes 140 past the stator vanes 130. In some examples, an external energy source can rotate the shaft 102 in the power direction 104 to move the rotor vanes 140 past the stator vanes 130 to an angular position in which the rotor and stator vanes can pivot to respective closed positions. In some examples, two or more rotary motors similar to the rotary motor 100 may be stacked in series to generate continuous torque. For example, a first rotary motor and a second rotary motor may be coupled to a shaft. The first and second motors can be circumferentially offset from one another, such that when the rotor and stator vanes of the one of the motors are in respective open positions (i.e. the rotor vanes are moving past the stator vanes), the rotor and stator vanes of the other one of the motors are in respective closed positions and generating torque on the shaft to rotate the shaft in the power direction (and move the open rotor vanes circumferentially past the open stator vanes so that the rotor and stator vanes can pivot to respective closed positions).

Figure 17C:
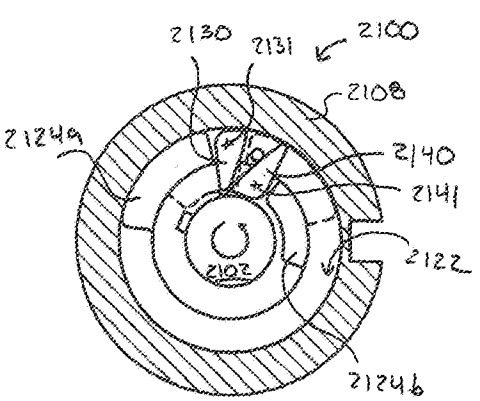
FIGS. 17*b*-17*f* are views of the same structure as FIG. 17*a*, showing a sequence of rotation from a first position in FIG. 17*a*, through second-sixth positions in FIGS. 17*b*-17*f*, respectively.
Figure 17B:
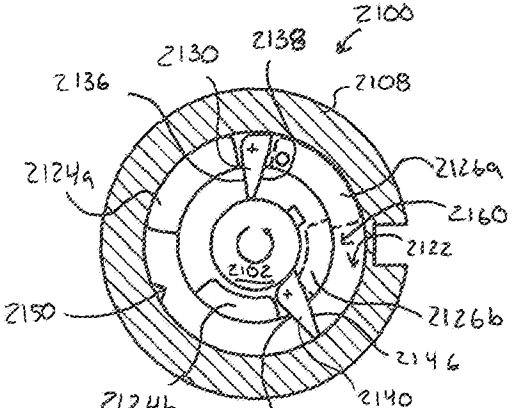
Figure 17A:
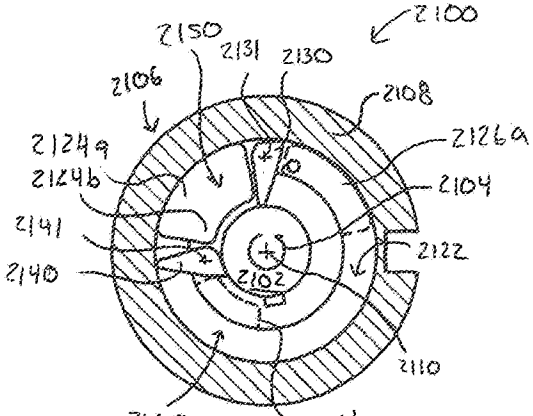
FIG. 17*a* is a partially schematic cross-sectional view of the motor of FIG. 15, shown in one condition.
Figure 17F:
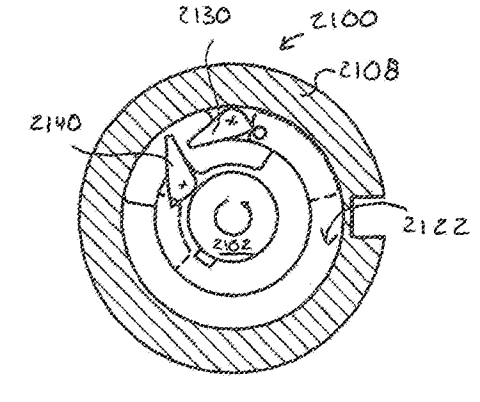
Figure 17E:
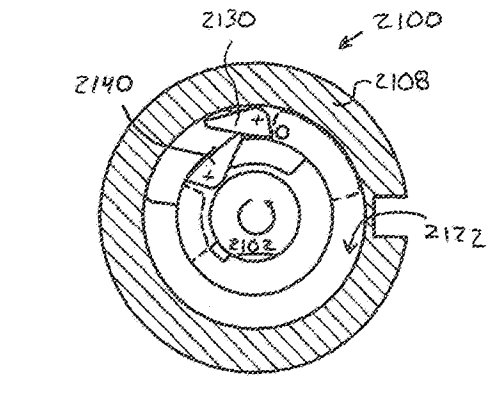
Figure 17D:
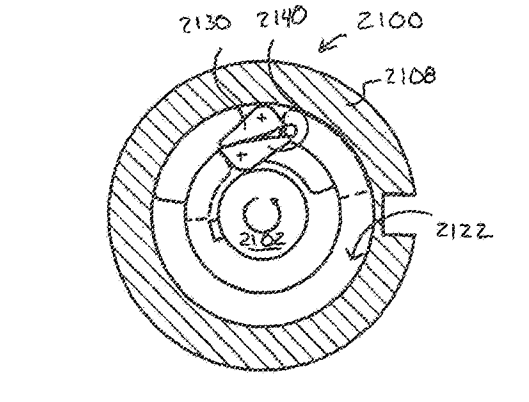

In some examples, the rotor and stator vanes 130, 140 may be moved from the closed position to the open position by contact between the rotor and stator vanes during rotation of the shaft 102 (see e.g. FIG. 17*d*). For example, the leading face of the rotor vane may engage the trailing face of the stator vane during rotation of the shaft, which may urge the rotor and stator vanes towards respective open positions. In some examples, the rotor and stator vanes 130, 140 may be moved from the open position to the closed position by the force exerted by pressurized fluid in the expanding chamber bounded by the respective rotor and stator vanes. In some examples, movement of the rotor and stator vanes between open and closed positions may be controlled mechanically, for example, by a vane pivoting mechanism. The vane pivoting mechanisms may include, for example, gear mechanisms, mechanical linkages, springs, and/or cams and cam followers for moving the rotor and stator vanes between the open and closed positions.

Referring to FIG. 3, the motor 100 includes a vane pivoting mechanism for pivoting the stator and rotor vanes 130, 140 between respective open and closed positions at predetermined angular positions of the shaft 102. In the example illustrated, the vane pivoting mechanism includes a stator vane pivoting mechanism 180 for pivoting the stator vanes 130*a*, 130*b* about respective stator vane axes 131*a*, 131*b*, and a rotor vane pivoting mechanism 190 for pivoting the rotor vanes 140*a*, 140*b* about respective rotor vane axes 141*a*, 141*b*. For simplicity, the pivoting mechanism 180 will be described only with respect to the stator vane 130*a*, and the pivoting mechanism 190 will be described only with respect to the rotor vane 140*a*.

Figure 7B:
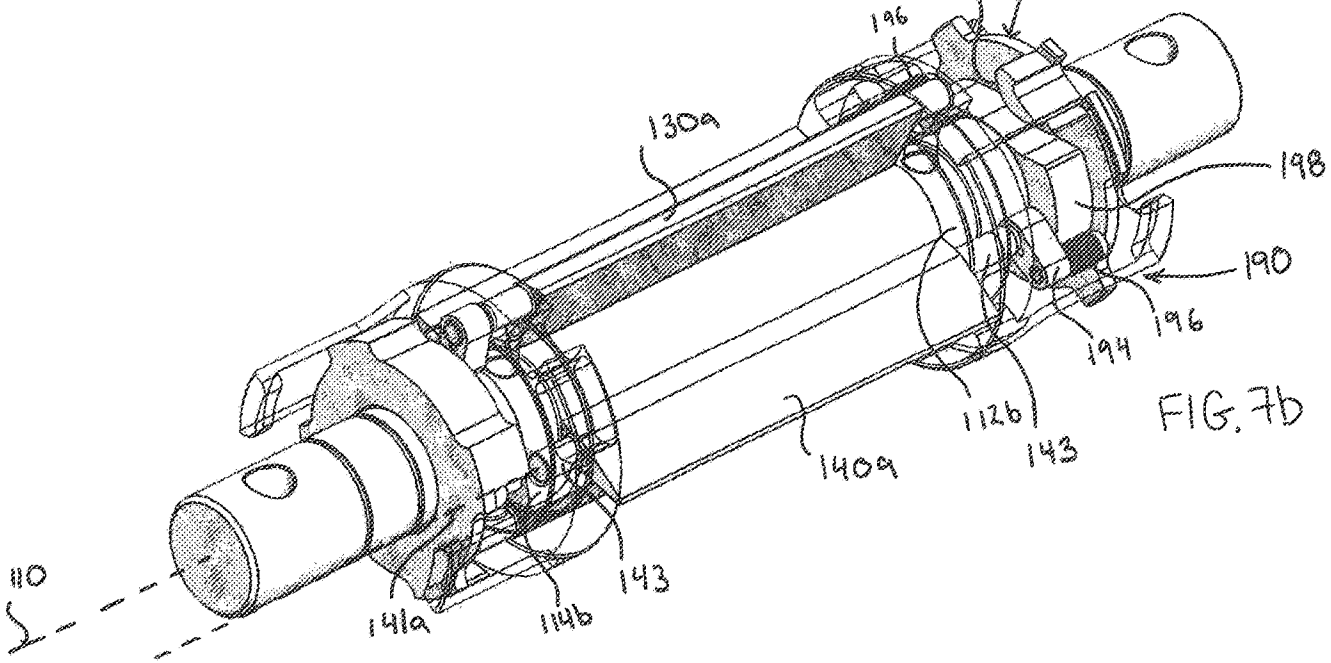
FIG. 7*b* is a perspective view of portions of the motor of FIG. 1 taken from a downstream end of the motor.

Referring to FIG. 7*b*, the rotor vane pivoting mechanism 190 includes a rotor vane actuator 192 and a rotor vane crank arm 194 fixed to and extending radially from one of the rotor vane pins 143. The rotor vane actuator 192 urges an outer end of the rotor vane crank arm 194 toward a rotor vane crank arm first radial position (shown in FIG. 9*a*) to urge the rotor vane 141*a* toward the rotor vane closed position. The rotor vane actuator 192 urges the outer end of the rotor vane crank arm 194 toward a rotor vane crank arm second radial position (shown in FIG. 9*b*) to urge the rotor vane toward the rotor vane open position. In the example illustrated, the rotor vane crank arm first radial position is radially outward of the rotor vane crank arm second radial position.

Figure 8A:
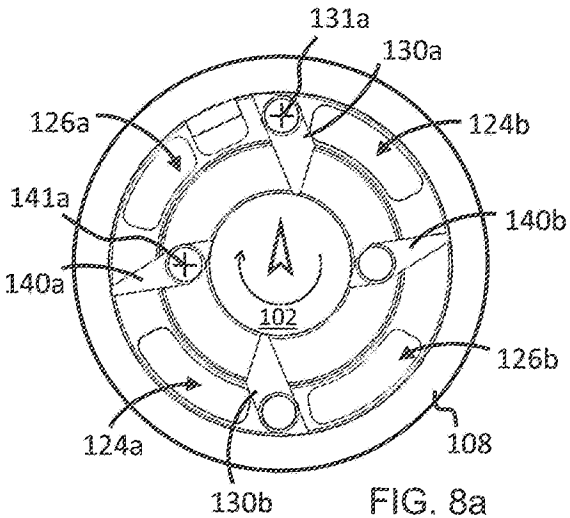
FIGS. 8*a*, 8*b*, and 8*c* are views of the structure of FIG. 6*a* with the shaft at three rotational positions (at approximately 0 degrees, 100 degrees, and 180 degrees, respectively)
Figure 8B:
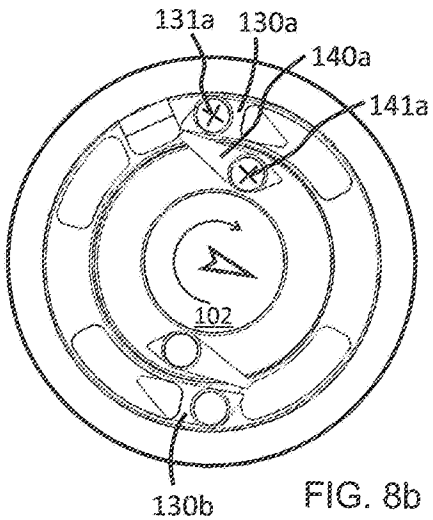
Figure 8C:
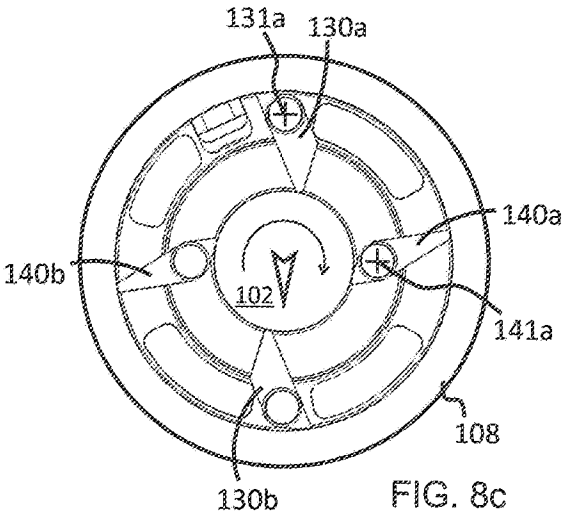
Figure 9A:
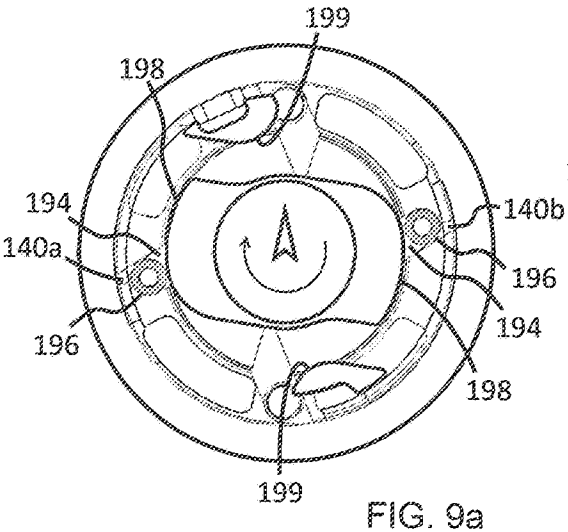
FIG. 9*a* is a partially schematic cross-sectional view of the motor of FIG. 5, taken along the lines 9*a*-9*a*, and with the shaft at a first rotational position corresponding to that of FIG. 8*a;*
Figure 9B:
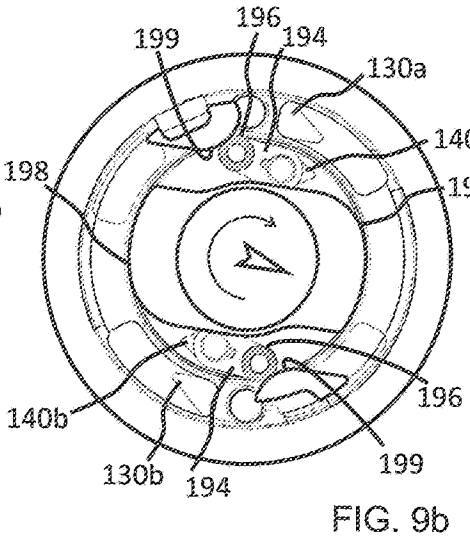
FIGS. 9*b* and 9*c* are views of the structure of FIG. 9*a* with the shaft at second and third positions, respectively, corresponding to the rotational positions of FIGS. 8*b* and 8*c;*
Figure 9C:
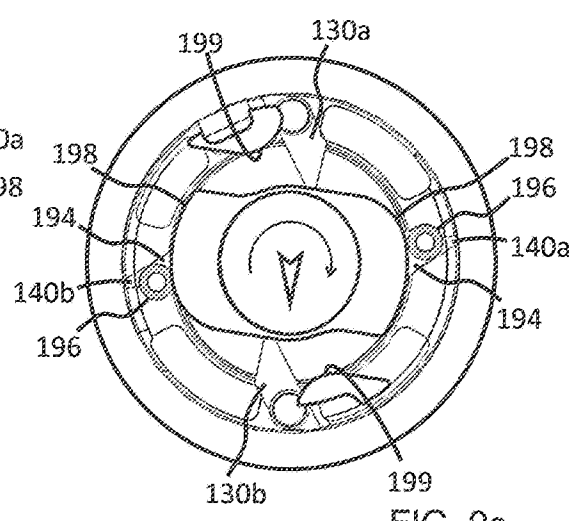

In the example illustrated, a rotor vane cam follower 196 is fixed to the outer end of the rotor vane crank arm 194. The rotor vane cam follower 196 can be, for example, a roller bearing. Referring to FIGS. 8*a* and 9*a*, the rotor vane actuator 192 includes two rotor vane first cam surfaces 198 that are directed radially outwardly and fixed relative to the casing 108. Each rotor vane first cam surface 198 can engage the rotor vane cam follower 196 at a respective predetermined angular position of the shaft 102 to push the radially outer end of the rotor vane crank arm 194 toward the rotor vane crank arm first radial position (and urge the rotor vane 140*a* toward the closed position). Referring to FIGS. 8*b* and 9*b*, in the example illustrated, the rotor vane actuator 192 further includes two rotor vane second cam surfaces 199 directed radially inwardly and fixed relative to the casing 108. Each rotor vane second cam surface 199 can engage the rotor vane cam follower 196 at a respective predetermined angular position of the shaft 102 to push the radially outer end of the rotor vane crank arm 194 toward the rotor vane crank arm second radial position (and urge the rotor vane 140*a* toward the open position). In the example illustrated, the rotor vane first and second cam surfaces 198, 199 are circumferentially spaced apart from one another, and the rotor vane first cam surfaces 198 are interposed between the rotor vane second cam surfaces 199.

Referring to FIG. 7*a*, the stator vane pivoting mechanism 180 includes a stator vane actuator 182 and a stator vane crank arm 184 fixed to and extending radially from one of the stator vane pins 133. The stator vane actuator 182 urges an outer end of the stator vane crank arm 184 toward a stator vane crank arm first radial position (shown in FIG. 10*a*) to urge the stator vane 130*a* toward the stator vane closed position. The stator vane actuator 182 urges the outer end of the stator vane crank arm 184 toward a stator vane crank arm second radial position (shown in FIG. 10*b*) to urge the stator vane 130*a* toward the stator vane open position. In the example illustrated, the stator vane crank arm first radial position is radially inward of the stator vane crank arm second radial position.

Figure 10C:
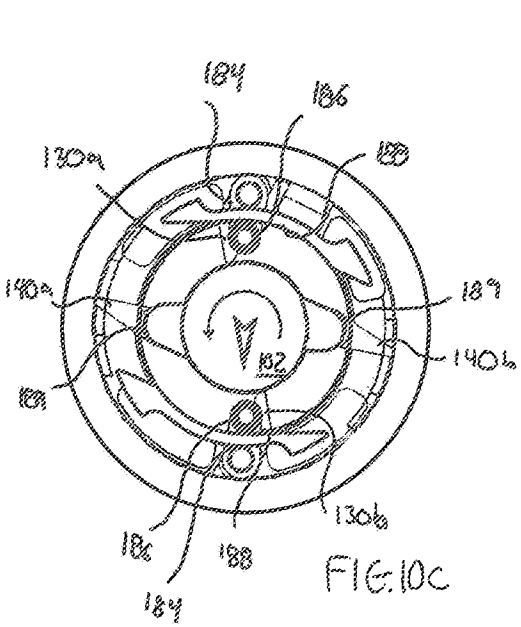
FIG. 10*c* is the schematic representation of FIG. 10*a* with the motor shown in another condition corresponding to that of FIG. 8*c;*
Figure 10B:
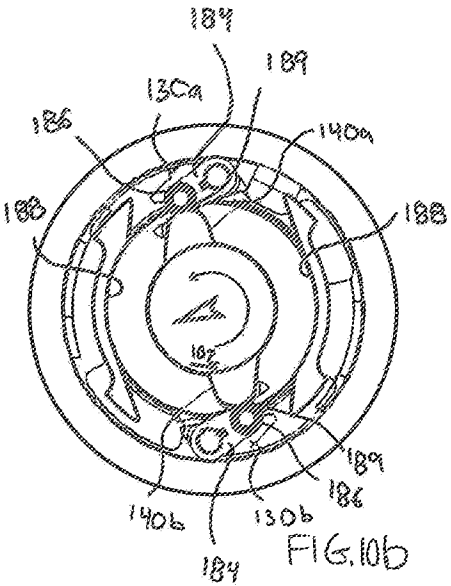
FIG. 10*b* is the schematic representation of FIG. 10*a* with the motor shown in another condition corresponding to that of FIG. 8*b;*
Figure 10A:
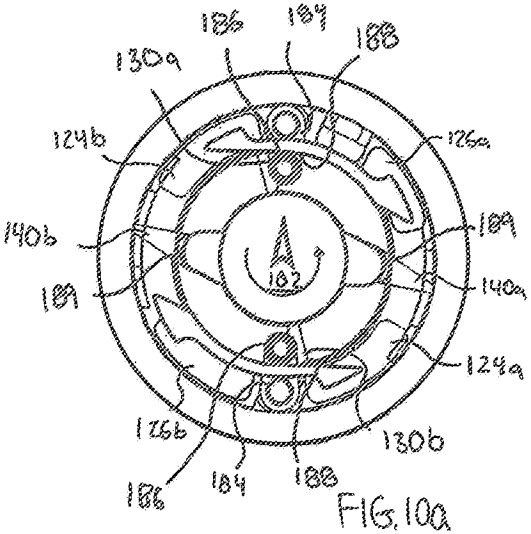
FIG. 10*a* is a partially schematic cross-sectional view of the motor of FIG. 4 taken along line 10*a*-10*a*, with the motor shown in a condition corresponding to that of FIG. 8*a;*

In the example illustrated, a stator vane cam follower 186 is fixed to the outer end of the stator vane crank arm 184. The stator vane cam follower 186 can be, for example, a roller bearing. Referring to FIGS. 8*a* and 10*a*, the stator vane actuator 182 includes two stator vane first cam surfaces 188 that are directed radially inwardly and fixed to rotate with the shaft 102. Each stator vane first cam surface 188 can engage the stator vane cam follower 186 at a respective predetermined angular position of the shaft 102 to push the radially outer end of the stator vane crank arm 184 toward the stator vane crank arm first radial position (and urge the stator vane 130*a* toward the closed position). Referring to FIGS. 8*b* and 10*b*, the stator vane actuator 182 further includes two radially outwardly directed stator vane second cam surfaces 189 fixed to rotate with the shaft 102. Each stator vane second cam surface 189 can engage the stator vane cam follower 186 at a respective predetermined angular position of the shaft 102 to push the radially outer end of the stator vane crank arm 184 toward the stator vane crank arm second radial position (and urge the stator vane 130*a* toward the stator vane open position). In the example illustrated, the stator vane first and second cam surfaces 188, 189 are circumferentially spaced apart from one another, and the rotor vane first cam surfaces 188 are interposed between the rotor vane second cam surfaces 189.

In the example illustrated, the rotor and stator vanes 130, 140 can lock in the closed position upon reverse rotation of the shaft 102 relative to the casing 108 (i.e. either by rotating the shaft 102 in the reverse rotational direction with the casing 108 fixed, or by rotating the casing 108 in the power direction and holding the shaft 102 fixed). This can advantageously transfer torque during such rotation through the vane pins rather than through interference between the cam and cam follower, which may be mechanically weaker than the connection provided by the vane pins. In some examples, it may be desirable to have the motor free-wheel when the shaft rotates in the reverse direction (second rotational direction) relative to the casing 108.

In some examples, the open position of the stator vanes and rotor vanes may be limited to a particular angular position about their respective axes that is sufficient to accommodate movement of the rotor and stator vanes past one another during rotation of the shaft, but limits overtravel of the vanes past this position. Limiting the overtravel may help prevent undesired interference or jamming of the vanes during non-steady state operating conditions (e.g. during start-up), and can help to limit the rotational displacement required to return the vanes to the closed position, which may reduce stresses imposed on the vane pivoting mechanism(s) and may increase power and torque output.

In some example, the maximum open position of the stator vanes 130 can be defined by contact of the leading face 136 of the stator vane 130 with the inner surface of the casing 108. Similarly, the maximum open position of the rotor vanes 140 can be defined by contact of the trailing face 148 with the shaft 102. In some examples, the maximum open positions can be defined by abutment surfaces provided in the vane pivoting mechanisms 180, 190.

Figure 11A:
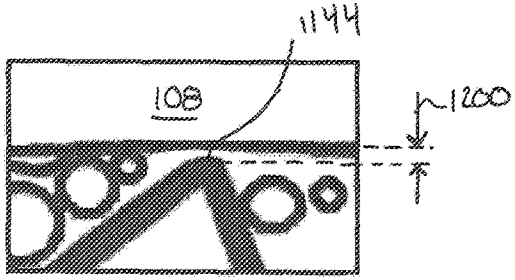
FIG. 11*a* is an enlarged portion of FIG. 11.
Figure 11:
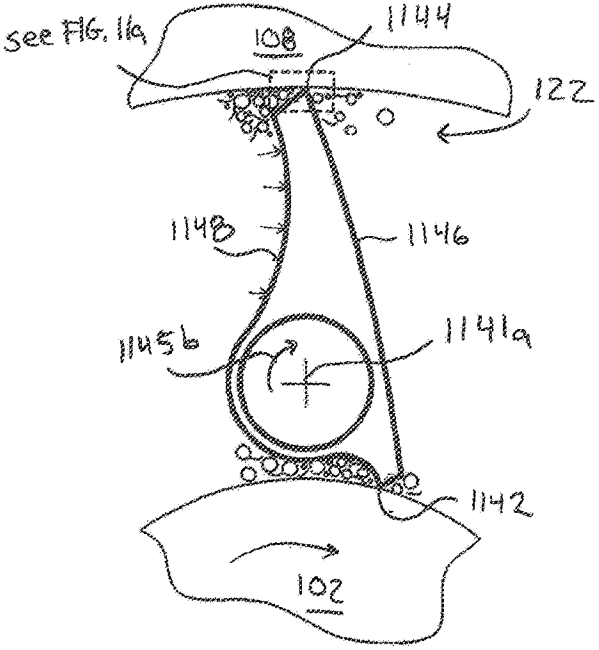
FIG. 11 is an end view of a portion of a motor similar to FIG. 1, showing an alternate rotor vane in one condition.

Referring to FIG. 11, an example of another rotor vane 1140*a* for use with the rotary motor 100 is illustrated. The rotor vane 1140*a* has similarities to the rotor vane 140*a*, and like features are identified by like reference characters, incremented by 1000.

In the example illustrated, the rotor vane 1140*a* has a rotor vane height bounded by a rotor vane root edge 1142 and an opposed rotor vane tip edge 1144. When the rotor vane 1140*a* is in the rotor vane closed position (FIG. 11), the rotor vane root edge 1142 is proximate the shaft 102 and the rotor vane tip edge 1144 is proximate the casing 108. Referring to FIG. 11*a*, in the example illustrated, when the rotor vane 1140*a* is in the rotor vane closed position, the rotor vane tip edge 1144 is spaced radially apart from the casing 108 by a rotor vane clearance gap 1200 for permitting interference free movement of the rotor vane tip edge 1144 relative to the casing 108 during rotation of the shaft 102.

Figure 12A:
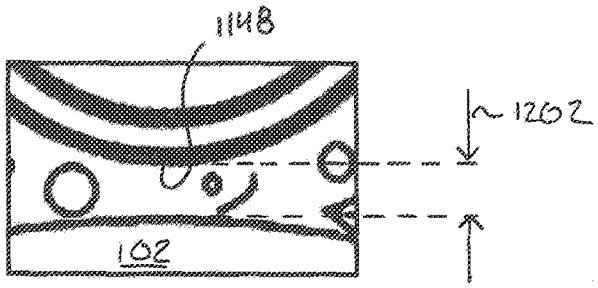
FIG. 12*a* is an enlarged portion of FIG. 12.
Figure 12:
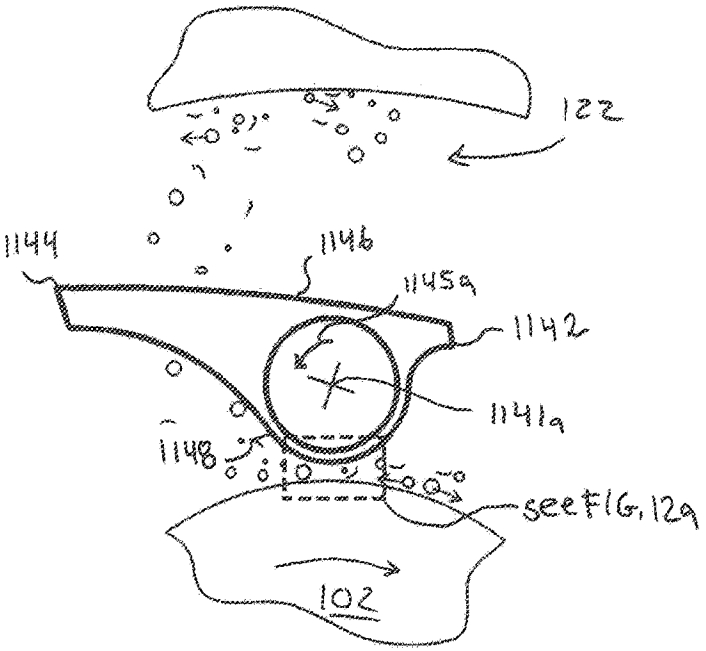
FIG. 12 is the same view of the motor of FIG. 11, showing the rotor vane in another condition.

In the example illustrated, the rotor vane 1140*a* has a rotor vane thickness bounded by a rotor vane leading face 1146 and an opposed rotor vane trailing face 1148. Referring to FIG. 12, when the rotor vane 1140*a* is in the rotor vane open position, the rotor vane trailing face 1148 is directed generally radially inwardly toward the shaft 102, and the rotor vane leading face 1146 is directed generally radially outwardly toward the casing 108. Referring to FIG. 12*a*, when the rotor vane 1140*a* is in the rotor vane open position, the rotor vane trailing face 1148 is spaced radially apart from the shaft by a rotor vane flow gap 1202. The rotor vane flow gap 1202 can permit circumferential fluid flow in the passage 122 across the rotor vane 1140*a*. This may help wash away particles that may accumulate adjacent the rotor vane root edge 1142 when the rotor vane 1140*a* is in the rotor vane closed position, which may help improve operational efficiency of the motor and reduce the likelihood of the motor jamming due to a buildup of particles within the passage 122.

Figure 13:
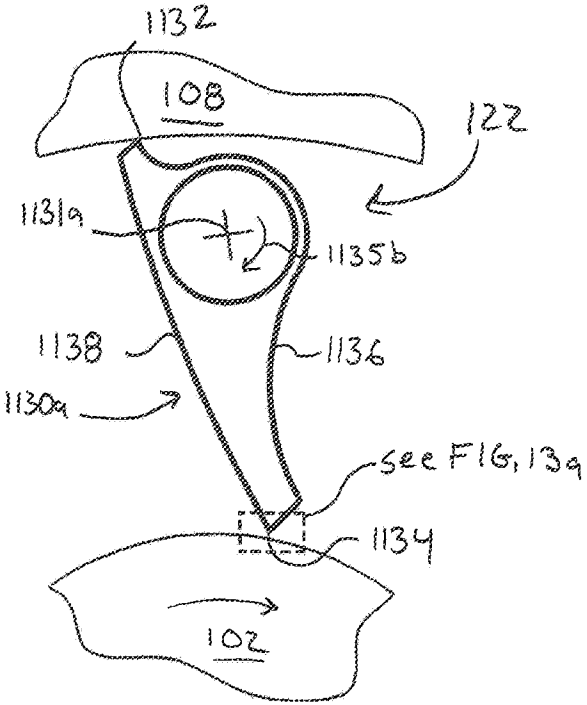
FIG. 13 is an end view of a portion of a motor similar to that of FIG. 1, showing an alternate stator vane in one condition.

Referring to FIG. 13, an example of another stator vane 1130*a* for use with the rotary motor 100 is illustrated. The stator vane 1130*a* has similarities to the stator vane 130*a*, and like features are identified by like reference characters, incremented by 1000.

Figure 13A:
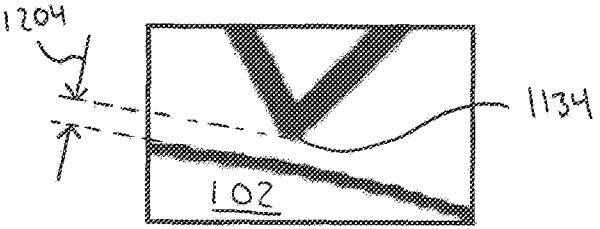
FIG. 13*a* is an enlarged portion of FIG. 13.

In the example illustrated, the stator vane 1130*a* has a stator vane height bounded by a stator vane root edge 1132 and an opposed stator vane tip edge 1134. When the stator vane 1130*a* is in the stator vane closed position (FIG. 13), the stator vane root edge 1132 is proximate the casing 108 and the stator vane tip edge 1134 is proximate the shaft 102. Referring to FIG. 13*a*, in the example illustrated, when the stator vane 1130*a* is in the stator vane closed position, the stator vane tip edge 1134 is spaced radially apart from the shaft 102 by a stator vane clearance gap 1204 for permitting interference free rotation of the shaft 102 relative to the stator vane tip edge 1134.

Figure 14:
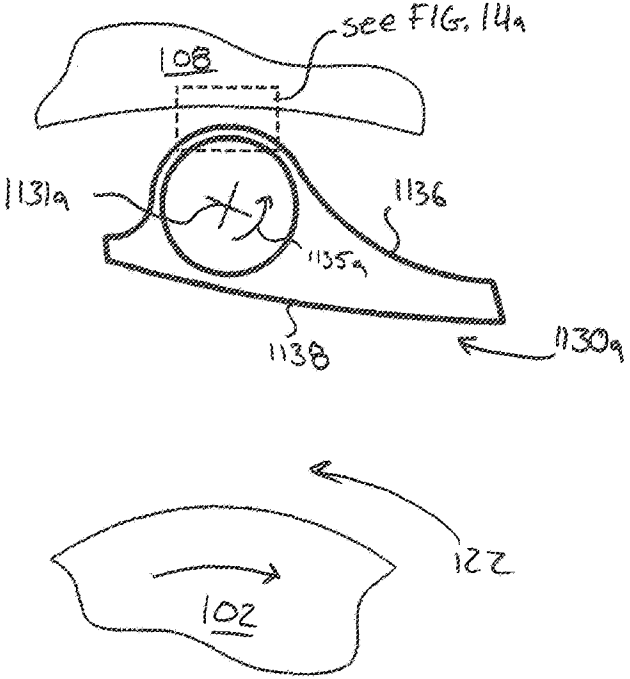
FIG. 14 is the same view of the motor of FIG. 13, showing the stator vane in another condition.
Figure 14A:
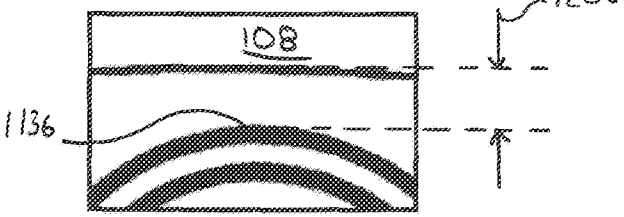
FIG. 14*a* is an enlarged portion of FIG. 14.

In the example illustrated, the stator vane 1130*a* has a stator vane thickness bounded by a stator vane leading face 1136 and an opposed stator vane trailing face 1138. Referring to FIG. 14, when the stator vane 1130*a* is in the stator vane open position, the stator vane trailing face 1138 is directed generally radially inwardly toward the shaft 102, and the stator vane leading face 1136 is directed generally radially outwardly toward the casing 108. Referring to FIG. 14*a*, when the stator vane 1130*a* is in the stator vane open position, the stator vane leading face 1136 is spaced radially apart from the casing 108 by a stator vane flow gap 1206. The stator vane flow gap 1206 can permit circumferential fluid flow in the passage 122 across the stator vane 1130*a*. This may help wash away particles that may accumulate adjacent the stator vane root edge 1132 when the stator vane 1130*a* is in the stator vane closed position, which may help improve operational efficiency of the motor and reduce the likelihood of the motor jamming due to a buildup of particles within the passage 122.

Figure 15:
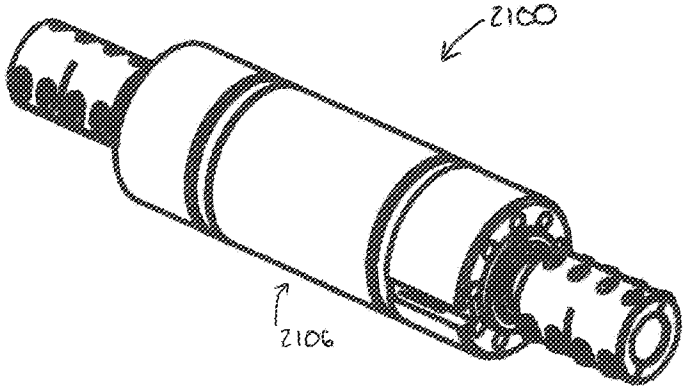
FIG. 15 is a perspective view of another rotary motor.

Referring to FIG. 15, an example of another rotary motor 2100 is illustrated. The motor 2100 has similarities to the motor 100, and like features are identified by like reference characters, incremented by 2000.

Figure 16:
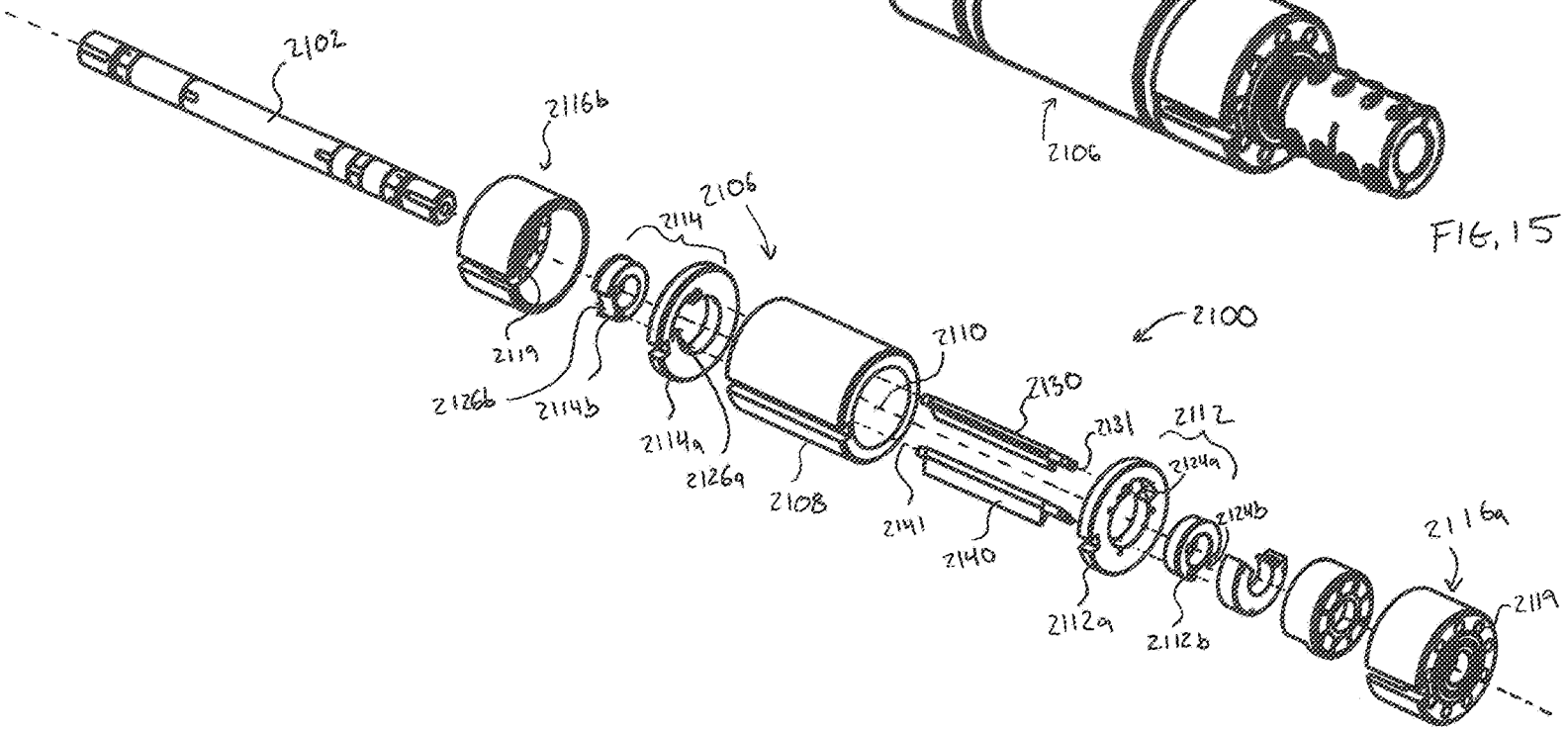
FIG. 16 is an exploded view of the motor of FIG. 15.

Referring to FIG. 16, in the example illustrated, the rotary motor 2100 includes a housing 2106 having a cylindrical casing 2108 extending along a drive axis 2110 between axially spaced apart first and second end caps 2112, 2114. A shaft 2102 is rotatably mounted within the housing 2106 and is rotatable relative to the casing 2108 about the drive axis 2110.

In the example illustrated, the first end cap 2112 includes a radially outer first stator disc 2112*a* fixed relative to the casing 2108, and a radially inner first rotor disc 2112*b* that is rotatable relative to the casing 2108 about the drive axis 2110. The second end cap 2114 includes a radially outer second stator disc 2114*a* fixed relative to the casing 2108 and a radially inner second rotor disc 2114*b* that is rotatable relative to the casing 2108 about the drive axis 2110. Each of the first and second rotor discs 2112*b*, 2114*b* is fixed to rotate with the shaft 2102 about the drive axis 2110.

In the example illustrated, the shaft 2102 is rotatably supported by a pair of bearing assemblies 2116*a*, 2116*b* mounted to the housing 2106. Each bearing assembly 2116*a*, 2116*b* includes a plurality of flow passages 2119.

In the example illustrated, the motor 2100 includes an annular passage 2122 within the housing 2106 (see FIG. 17*a*). The annular passage 2122 is radially intermediate the shaft 2102 and the casing 2108, and is bounded axially by the first and second end caps 2112, 2114. In the example illustrated, the motor 2100 includes two inlets 2124*a*, 2124*b* in the housing 2106 for conducting fluid into the annular passage 2122, and two outlets 2126*a*, 2126*b* in the housing 2106 for evacuating fluid from the annular passage 2122 (see also FIG. 17*a*). The inlets 2124*a*, 2124*b* extend axially through the first end cap 2112, and the outlets 2126*a*, 2126*b* extend axially through the second end cap 2114. In the example illustrated, the inlet 2124*a* extends axially through and is fixed relative to the first stator disc 2112*a*, and the inlet 2124*b* extends axially through and is fixed relative to the first rotor disc 2112*b*. The outlet 2126*a* extends axially through and is fixed relative to the second stator disc 2114*a*, and the outlet 2126*b* extends axially through and is fixed relative to the second rotor disc 2114*b*.

In the example illustrated, the motor 2100 includes a stator vane 2130 extending axially across the passage 2122. Referring to FIG. 17*a*, the stator vane 2130 is pivotable about a stator vane axis 2131 fixed relative to the casing 2108. The stator vane axis 2131 passes through the passage 2122 and extends parallel to the drive axis 2110. The stator vane 2130 is pivotable about the stator vane axis 2131 between a stator vane closed position (shown in FIG. 17*a*) for inhibiting circumferential fluid flow in the passage 2122 across the stator vane 2130, and a stator vane open position (shown in FIG. 17*e*).

Referring to FIG. 16, in the example illustrated, the motor 2100 includes a rotor vane 2140 extending axially across the passage 2122. Referring to FIG. 17*a*, the rotor vane 2140 is pivotable about a rotor vane axis 2141 fixed relative to the shaft 2102. The rotor vane axis 2141 passes through the passage 2122 and extends parallel to the drive axis 2110. Referring to FIG. 17*a*, the rotor vane 2140 is pivotable about the rotor vane axis 2141 between a rotor vane closed position (shown in FIG. 17*a*) for inhibiting circumferential fluid flow in the passage 2122 across the rotor vane 2140, and a rotor vane open position (shown in FIG. 17*d*).

Referring to FIG. 17*a*, when in respective closed positions, the stator and rotor vanes 2130, 2140 separate the passage 2122 into a circumferentially expanding chamber 2150 and a circumferentially collapsing chamber 2160 that is spaced circumferentially apart from the expanding chamber 2150. Referring to FIG. 17*b*, in the example illustrated, the expanding chamber 2150 is bounded circumferentially by a trailing face 2148 of the rotor vane 2140 and a leading face 2136 of the stator vane 2130. The collapsing chamber 2160 is bounded circumferentially by the leading face 2146 of the rotor vane 2140 and the trailing face 2138 of the stator vane 2130.

In the example illustrated, the expanding chamber 2150 is in fluid communication with the inlets 2124*a*, 2124*b* for receiving pressurized fluid. The pressurized fluid can bear against the trailing face 2148 of the rotor vane 2140 to urge rotation of the shaft 2102 in the power direction 2104. The collapsing chamber 2160 is in fluid communication with the outlets 2126*a*, 2126*b* for evacuating fluid from the collapsing chamber 2160 during rotation of the shaft 2102 in the power direction 2104. As the shaft 2102 rotates in the power direction 2104, the leading face 2146 of the rotor vane 2140 bears against fluid in the collapsing chamber 2160 to urge evacuation of the fluid via the outlets 2126*a*, 2126*b*.

Referring to FIG. 17*d*, when the rotor and stator vanes 2130, 2140 are in respective open positions, the rotor vane 2140 can move circumferentially past the stator vane 2130 during rotation of the shaft 2102. In the example illustrated, the rotor vane axis 2141 is radially offset from the stator vane axis 2131. In the example illustrated, the rotor vane axis 2141 is offset radially inwardly toward the shaft 2102 and the stator vane axis 2131 is offset radially outwardly toward the casing 2108. When the rotor and stator vanes 2130, 2140 are in respective open positions, the stator vane trailing face 2138 is spaced radially apart from the shaft 2102 and the rotor vane leading face 2146 is spaced radially apart from the casing 2108 to permit circumferential movement of the rotor vane 2140 past the stator vane 2130.

Referring to FIG. 18*a*, an example of another rotary motor 3100 is illustrated. The motor 3100 has similarities to the motor 100, and like features are identified by like reference characters, incremented by 3000.

In the example illustrated, the motor 3100 includes three stator vanes 3130*a*, 3130*b*, 3130*c*, each pivotable about a respective stator vane axis 3131. The stator vane axes 3131 are spaced equally apart about the drive axis 3110. Each stator vane 3130 is associated with a respective inlet 3124 and a respective outlet 3126, with the respective inlet 3124 and the respective outlet 3126 disposed on circumferentially opposite sides of the stator vane 3130 when the stator vane 3130 is in the stator vane closed position. In the example illustrated, at any angular position of the shaft 3102, at least one of the stator vanes 3130*a*, 3130*b*, 3130*c* is in the stator vane closed position, and includes a trailing face 3138 circumferentially bounding a collapsing chamber and a leading face 3136 circumferentially bounding a expanding chamber within the passage 3112.

In the example illustrated, the motor 3100 further includes two rotor vanes 3140*a*, 3140*b* fixed to rotate with the shaft 3102, each pivotable about a respective rotor vane axis 3141. The sequence of rotation of the shaft 3102 in a first rotational direction (counter-clockwise in the Figures) is illustrated in FIGS. 18*a*-18*f*.

Figure 19A:
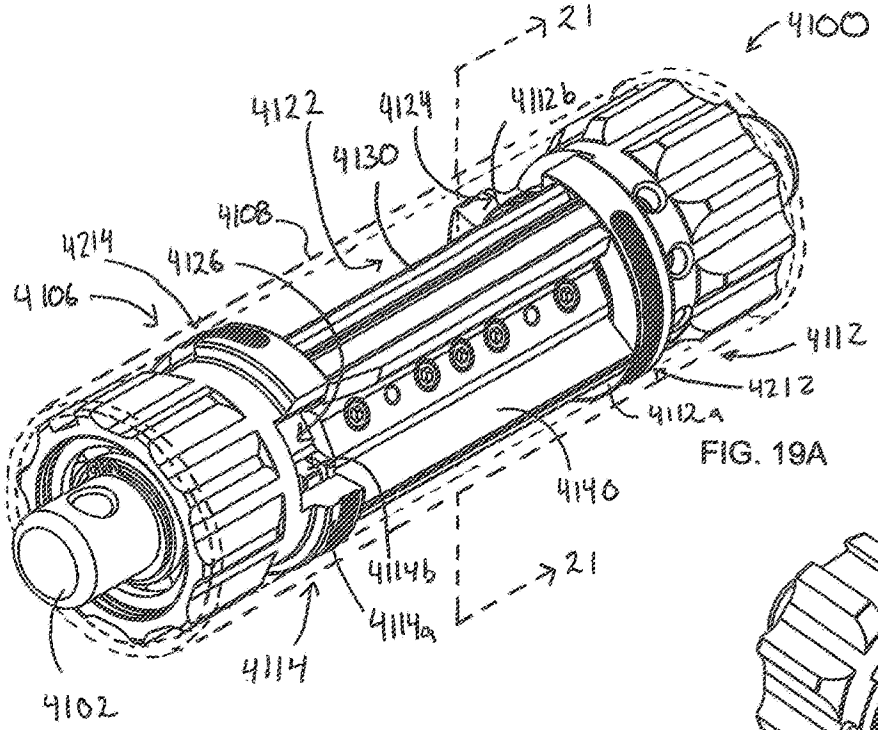
FIG. 19A is a perspective view of portions of another rotary motor taken from a downstream end of the motor.
Figure 19B:
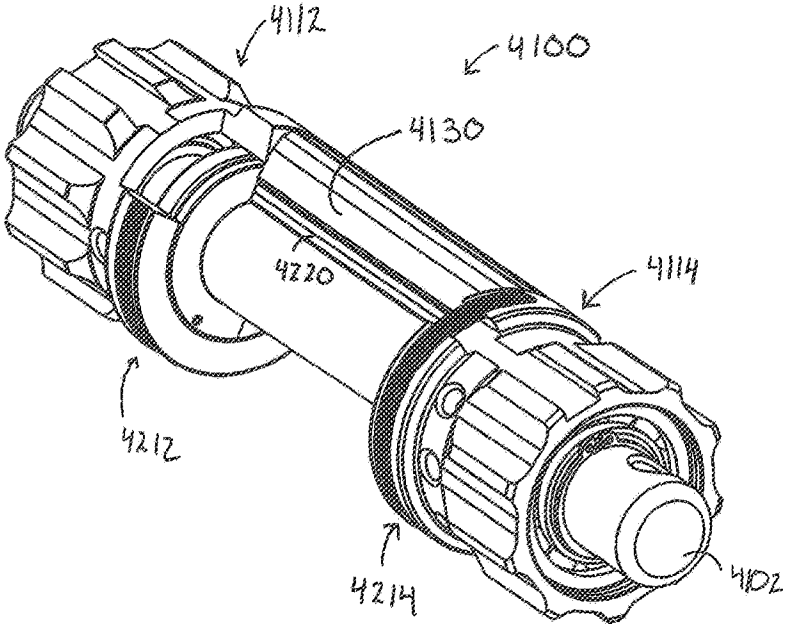
FIG. 19B is another perspective view of portions of the motor of FIG. 19A taken from a downstream end of the motor.

Referring to FIG. 19A, an example of another rotary motor 4100 is illustrated. The motor 4100 has similarities to the motor 100, and like features are identified by like reference characters, incremented by 4000.

In the example illustrated, the rotary motor 4100 includes a housing 4106 having a cylindrical casing 4108 (shown in phantom lines in FIG. 19A) extending between axially spaced apart first and second end caps 4112, 4114. A shaft 4102 is rotatably mounted within the housing 4106. In the example illustrated, the first end cap 4112 includes a radially outer first stator disc 4112*a* and a radially inner first rotor disc 4112*b*, and the second end cap 4114 includes a radially outer second stator disc 4114*a* and a radially inner second rotor disc 4114*b*. At least one inlet 4124 extends through the first end cap 4112 for conducting fluid into an annular passage 4122 within the housing 4106. At least one outlet 4126 extends through the second end cap 4114 for evacuating fluid from the annular passage 4122.

Figure 20:
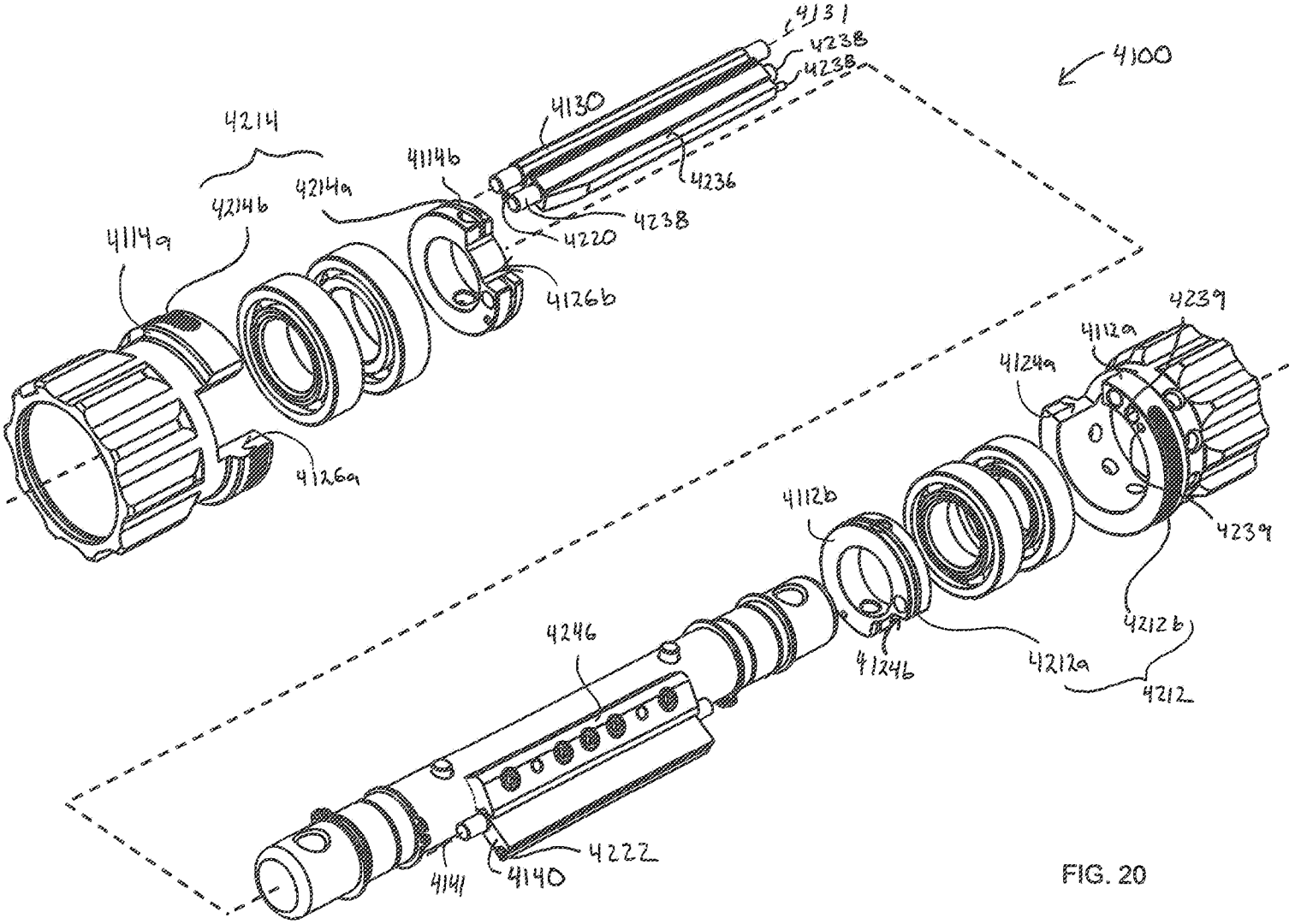
FIG. 20 is an exploded view of portions of the motor of FIG. 19A.

Referring to FIG. 20, in the example illustrated, the at least one inlet 4124 comprises a first inlet 4124*a* extending through and fixed relative to the first stator disc 4112*a*, and a second inlet 4124*b* extending through and fixed to rotate with the first rotor disc 4112*b*. In the example illustrated, the at least one outlet 4126 comprises a first outlet 4126*a* extending through and fixed relative to the second stator disc 4114*a*, and a second outlet 4126*b* extending through and fixed to rotate with the second rotor disc 4114*b*.

In the example illustrated, each of the inlet 4124 and the outlet 4126 extend axially through respective end caps 4112, 4114. In some examples, one or both of the inlet 4124 and the outlet 4126 can extend radially through the casing 4108. In some examples, the shaft 4102 can comprise an internal shaft conduit for conducting fluid, and one or both of the inlet 4124 and the outlet 4126 can extend radially through the shaft 4102 for conducting fluid between the passage 4122 and the shaft conduit.

Figure 21:
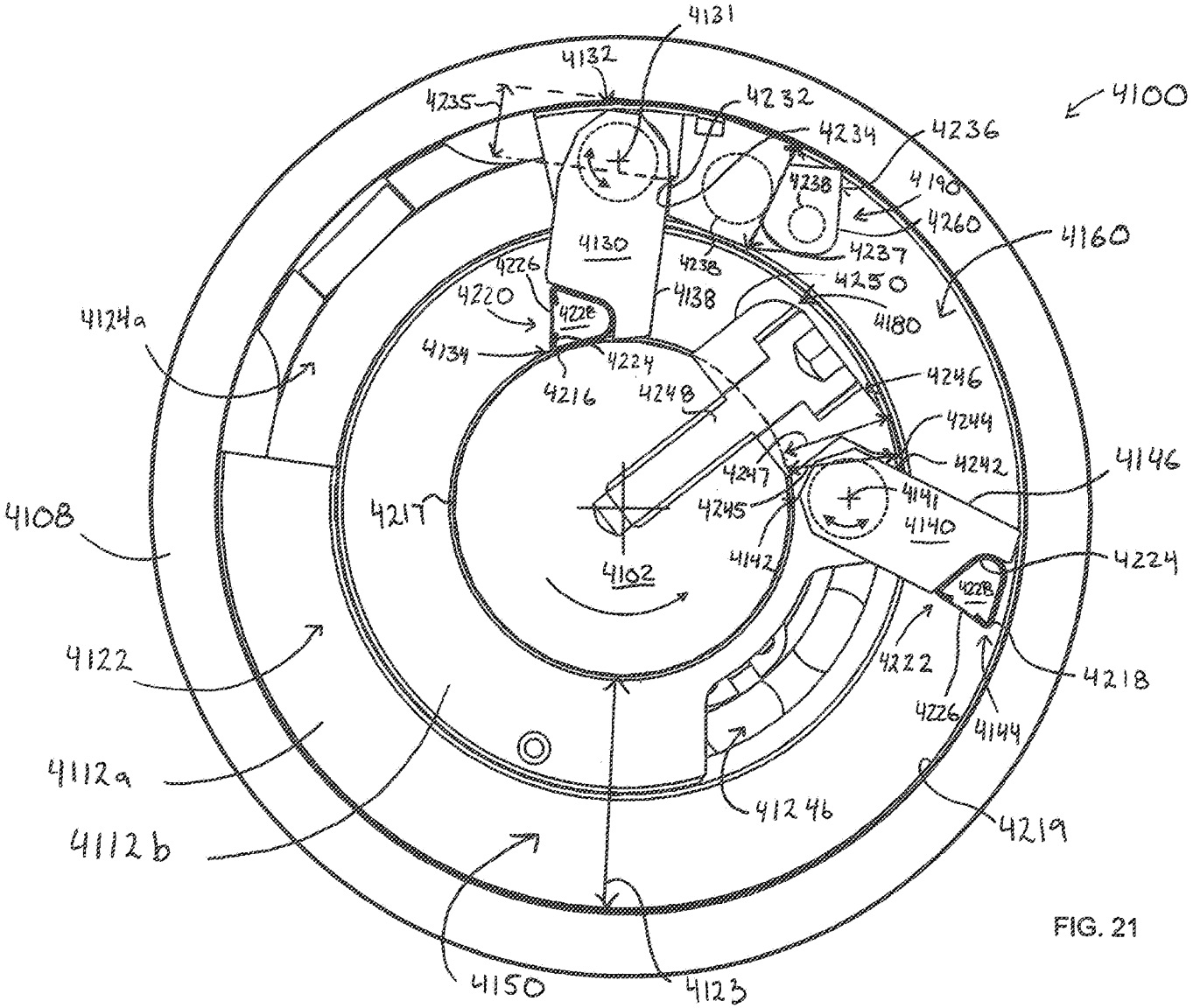
FIG. 21 is a partially schematic cross-sectional view of the motor of FIG. 19A taken along line 21-21 of FIG. 19A.

In the example illustrated, the motor 4100 includes a stator vane 4130 and a rotor vane 4140, each pivotable about a respective vane axis 4131, 4141 between respective open and closed positions. Referring to FIG. 21, when in respective closed positions, the stator and rotor vanes 4130, 4140 separate the passage 4122 into a circumferentially expanding chamber 4150 in fluid communication with the inlets 4124 for receiving pressurized fluid, and a circumferentially collapsing chamber 4160 in fluid communication with the outlets 4126 for evacuating fluid. In FIG. 21, the stator vane 4130 is shown in the closed position and the rotor vane 4140 is shown in a partially open position.

Referring to FIG. 20, in the example illustrated, the first end cap 4112 includes a first end cap seal 4212 for inhibiting leakage of fluid into the collapsing chamber 4160. In the example illustrated, the first end cap seal 4212 includes a first disc seal 4212*a* radially intermediate the first stator disc 4112*a* and the first rotor disc 4112*b* for sealing the interface between at least a portion of the radially outer surface of the first rotor disc 4112*b* and at least a portion of the radially inner surface of the first stator disc 4112*a*. In the example illustrated, the first end cap seal 4212 further includes a first casing seal 4212*b* radially intermediate the first stator disc 4112*a* and the casing 4108 for sealing the interface between at least a portion of a radially outer surface of the first stator disc 4112*a* and at least a portion of the radially inner surface of the casing 4108.

In the example illustrated, the second end cap 4114 includes a second end cap seal 4214 for inhibiting leakage of fluid out from the expanding chamber 4150. In the example illustrated, the second end cap seal 4214 includes a second disc seal 4214*a* radially intermediate the second stator disc 4114*a* and the second rotor disc 4114*b* for sealing the interface between at least a portion of the radially outer surface of the second rotor disc 4114*b* and at least a portion of the radially inner surface of the second stator disc 4114*a*. In the example illustrated, the second end cap seal 4214 further includes a second casing seal 4214*b* radially intermediate the second stator disc 4114*a* and the casing 4108 for sealing the interface between at least a portion of a radially outer surface of the second stator disc 4114*a* and at least a portion of the radially inner surface of the casing 4108.

Referring to FIG. 21, in the example illustrated, the stator vane 4130 has a stator vane height bounded by a stator vane root edge 4132 and an opposed stator vane tip edge 4134. In the example illustrated, the stator vane tip edge 4134 includes a stator vane tip seal surface 4216. In the example illustrated, the stator vane tip seal surface 4216 engages a rotor engagement surface 4217 fixed relative to the shaft 4102 in sealed sliding fit when the stator vane 4130 is in the closed position to inhibit circumferential fluid flow across the stator vane 4130. In the example illustrated, the rotor engagement surface 4217 comprises at least a portion of an outer surface of the shaft 4102.

In the example illustrated, the rotor vane 4140 has a rotor vane height bounded by a rotor vane root edge 4142 and an opposed rotor vane tip edge 4144. In the example illustrated, the rotor vane tip edge 4144 includes a rotor vane tip seal surface 4218. The rotor vane tip seal surface 4218 engages a stator engagement surface 4219 fixed relative to the casing 4108 in sealed sliding fit when the rotor vane 4140 is in the closed position to inhibit circumferential fluid flow across the rotor vane 4140. In the example illustrated, the stator engagement surface 4219 comprises at least a portion of an inner surface of the casing 4108.

In the example illustrated, the stator vane 4130 includes a stator vane seal 4220, and the rotor vane 4140 includes a rotor vane seal 4222. In the example illustrated, each of the seals 4220, 4222 extends axially across the passage 4122. Each of the seals 4220, 4222 can be spring loaded for pushing a respective stator vane and rotor vane tip seal surface 4216, 4218 against a respective rotor and stator engagement surface 4217, 4219 when the rotor and stator vanes are in the closed positions. In the example illustrated, each of the seals 4220, 4222 includes a U-shaped flat spring 4224 enclosed in a plastic wrap 4226. In the example illustrated, the seal surfaces 4216, 4218 comprise a portion of an outer surface of the plastic wrap 4226. The plastic wrap can comprise, for example, Polytetrafluoroethylene (PTFE) or Polyether ether ketone (PEEK). In some examples, an interior 4228 of the spring 4224 can be filled with a deformable material to inhibit particles from accumulating within the interior 4228. The deformable material can include, for example, an elastomer.

In some examples, each seal 4220, 4222 can comprise an elastomer coating comprising the respective seal surfaces 4216, 4218. In some examples, an entirety of the outer surface of one or both of the vanes 4130, 4140 can comprise an elastomer coating. In some examples, the outer surface of the shaft 4102 can comprise an elastomer coating for facilitating sealing of the interface between the stator vane tip seal surface 4216 and the rotor engagement surface 4217. In some examples, the inner surface of the casing 4108 can comprise an elastomer coating for facilitating sealing of the interface between the rotor vane tip seal surface 4218 and the stator engagement surface 4219.

In the example illustrated, when the stator vane 4130 is in the stator vane closed position, a stator vane stop surface 4232 fixed to the stator vane 4130 abuts a stator abutment surface 4234 fixed relative to the casing 4108 to inhibit further pivoting of the stator vane 4130. When the stator vane 4130 is in the stator vane open position, the stator vane stop surface 4232 is spaced apart from the stator abutment surface 4234. In the example illustrated, the stator vane stop surface 4232 comprises a portion of a stator vane trailing face 4138 of the stator vane 4130.

In the example illustrated, the stator vane stop surface 4232 is intermediate the stator vane axis 4131 and the stator vane tip edge 4134. This may help reduce the reaction force exerted on the stator vane 4130 (including the stator vane pins pivotally supporting the stator vane 4130), may help reduce deflection of the stator vane tip edge 4134 relative to the shaft 4102, and may help reduce fluid leakage across the stator vane 4130 when pressurized fluid bears against the stator vane 4130 in the closed position.

In the example illustrated, the motor 4100 includes a stator block 4236 fixed relative to the casing 4108. In the example illustrated, the stator block 4236 extends axially across the passage 4122, and is proximate the casing 4108. In the example illustrated, the stator abutment surface 4234 comprises a portion of a leading surface of the stator block 4236.

The stator block 4236 can be fixed relative to the casing 4108 via stator block pins 4238. In the example illustrated, a single stator block pin 4238 projects axially from one axial endface of the stator block 4236, and is received in a respective stator block aperture 4239 in the second stator disc 4114*a*. In the example illustrated, a pair of stator block pins 4238 project axially from the other axial endface of the stator block 4236, and are received in respective stator block apertures 4239 in the first stator disc 4112*a*. The block pins 4238 can facilitate proper orientation and inhibit rotation of the stator block 4236 during installation, and outer surfaces of the stator block 4236 can engage components of the motor 4100 (e.g., the inner surface of the casing 4108) to inhibit rotation of the stator block 4236 during use.

Referring to FIG. 21, in the example illustrated, when the rotor vane 4140 is in the rotor vane closed position, a rotor vane stop surface 4242 fixed to the rotor vane 4140 abuts a rotor abutment surface 4244 fixed relative to the shaft 4102 to inhibit further pivoting of the rotor vane 4140. When the rotor vane 4140 is in the rotor vane open position, the rotor vane stop surface 4242 is spaced apart from the rotor abutment surface 4244. In the example illustrated, the rotor vane stop surface 4242 comprises a portion of a rotor vane leading face 4146 of the rotor vane 4140.

In the example illustrated, the rotor vane stop surface 4242 is intermediate the rotor vane axis 4141 and the rotor vane tip edge 4144. This may help reduce the reaction force exerted on the rotor vane 4140 (including the rotor vane pins pivotally supporting the rotor vane 4140), may help reduce deflection of the rotor vane tip edge 4144 relative to the casing 4108, and may help reduce fluid leakage across the rotor vane when pressurized fluid bears against the rotor vane 4140 in the closed position.

In the example illustrated, the rotor abutment surface 4244 is spaced radially outwardly from an outer diameter of the shaft 4102 by a rotor abutment surface distance 4235. In the example illustrated, the stator abutment surface 4234 is spaced radially inwardly from an inner diameter of the casing 4108 by a stator abutment surface distance 4235. In the example illustrated, the annular passage 4122 has a passage radial extent 4123. In the example illustrated, the passage radial extent 4123 is measured from an outer diameter of the shaft 4102 to an inner diameter of the casing 4108. In the example illustrated, the sum of the rotor abutment surface distance 4245 and the stator abutment surface distance 4235 is less than the passage radial extent 4123.

In the example illustrated, the motor 4100 includes a rotor block 4246 fixed to rotate with the shaft 4102. In the example illustrated, the rotor block 4246 extends axially across the passage 4122, and is proximate the shaft 4102. In the example illustrated, the rotor abutment surface 4244 comprises a portion of a trailing surface of the rotor block 4246. In the example illustrated, the rotor block 4246 is fixed to rotate with the shaft 4102 via a plurality of rotor block bolts 4248 passing radially through the rotor block 4246 and anchored in the shaft 4102.

In the example illustrated, the rotor block 4246 has a rotor block radial extent 4247 measured radially outwardly from an outer diameter of shaft 4102. In the example illustrated, the stator block 4236 has a stator block radial extent 4237 measured radially inwardly from the inner diameter of the casing 4108. In the example illustrated, a sum of the stator block radial extent 4237 and the rotor block radial extent 4247 is less than the passage radial extent 4123.

In the example illustrated, the motor 4100 includes a stator vane pivoting mechanism 4180 for pivoting the stator vane 4130 about the stator vane axis 4131, and a rotor vane pivoting mechanism 4190 for pivoting the rotor vane 4140 about the rotor vane axis 4141.

In the example illustrated, the stator vane pivoting mechanism 4180 comprises a stator vane actuation surface 4250 fixed to rotate with the shaft 4102. The stator vane actuation surface 4250 contacts the trailing face 4138 of the stator vane 4130 during rotation of the shaft 4102 for urging the stator vane from the closed position to the open position. In the example illustrated, the stator vane actuation surface 4250 is within the passage 4122 radially intermediate the stator vane axis 4131 and the shaft 4102. In the example illustrated, the stator vane actuation surface 4250 comprises a portion of a leading surface of the rotor block 4246.

In the example illustrated, the rotor vane pivoting mechanism 4190 comprises a rotor vane actuation surface 4260 fixed relative to the casing 4108. The leading face 4146 of the rotor vane 4140 contacts the rotor vane actuation surface 4260 during rotation of the shaft 4102 for urging the rotor vane 4140 from the closed position to the open position. In the example illustrated, the rotor vane actuation surface 4260 is within the passage 4122 radially intermediate the rotor vane axis 4141 and the casing 4108. In the example illustrated, the rotor vane actuation surface 4260 comprises a portion of a trailing surface of the stator block 4236.

In the example illustrated, after the rotor vane 4140 passes the stator vane 4130 during rotation of the shaft 4102, flow of fluid urges each of the rotor and stator vanes 4130, 4140 from respective open positions back to respective closed positions.

Figure 22A:
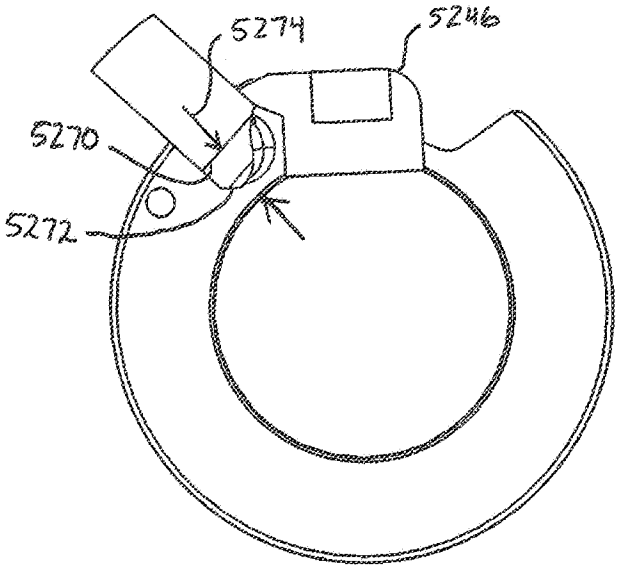
FIG. 22A is a cross-sectional view of the portions of the rotor structure of FIG. 22 taken along line 22A-22A of FIG. 22.
Figure 22:
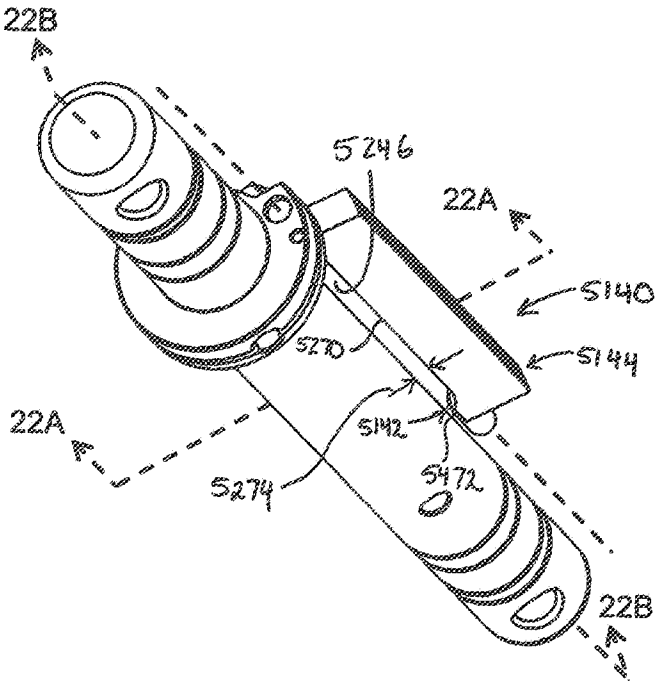
FIG. 22 is a perspective view of portions of another rotor structure for use with a motor like that of FIG. 19A.
Figure 22B:
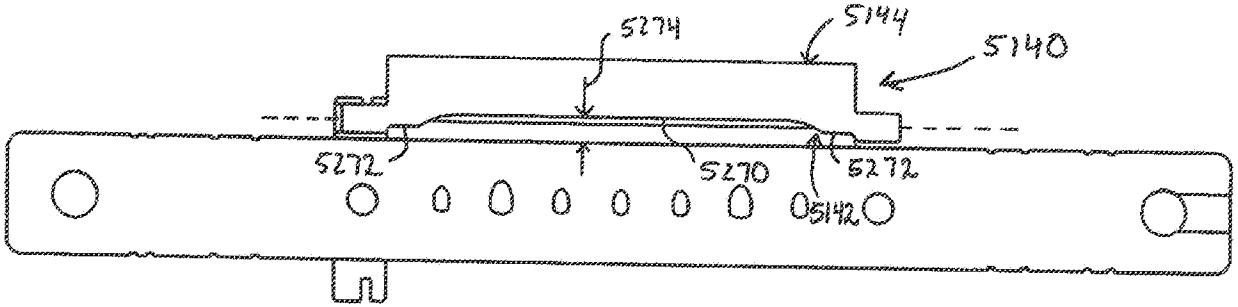
FIG. 22B is a cross-sectional view of the portions of the rotor structure of FIG. 22 taken along line 22B-22B of FIG. 22.

Referring to FIGS. 22 to 22B, an example of another rotor vane 5140 and rotor block 5246 is illustrated. The rotor vane 5140 has similarities to the rotor vane 4140, and like features are identified by like reference characters, incremented by 1000. The rotor block 5246 has similarities to the rotor block 4246, and like features are identified by like reference characters, incremented by 1000.

In the example illustrated, the rotor vane 5140 has a rotor vane height bounded by a rotor vane root edge 5142 and an opposed rotor vane tip edge 5144. In the example illustrated, the rotor vane root edge 5142 includes an inboard portion 5270 axially intermediate spaced apart outboard portions 5272 of the root edge 5142. In the example illustrated, the inboard portion 5270 is recessed toward the rotor vane tip edge 5144 relative to the outboard portions 5272 to provide a radial clearance 5274 between the inboard portion 5270 and a shaft of the motor. This may help wash away particles that may accumulate adjacent the rotor vane root edge 5142 and the rotor block 5246, which may help improve operational efficiency of the motor and reduce the likelihood of the motor jamming due to a buildup of particles.

In some examples, the motor may include a stator vane having a recessed inboard portion like the inboard portion 5270 of the rotor vane 5140.

Figures 23A, 23B:
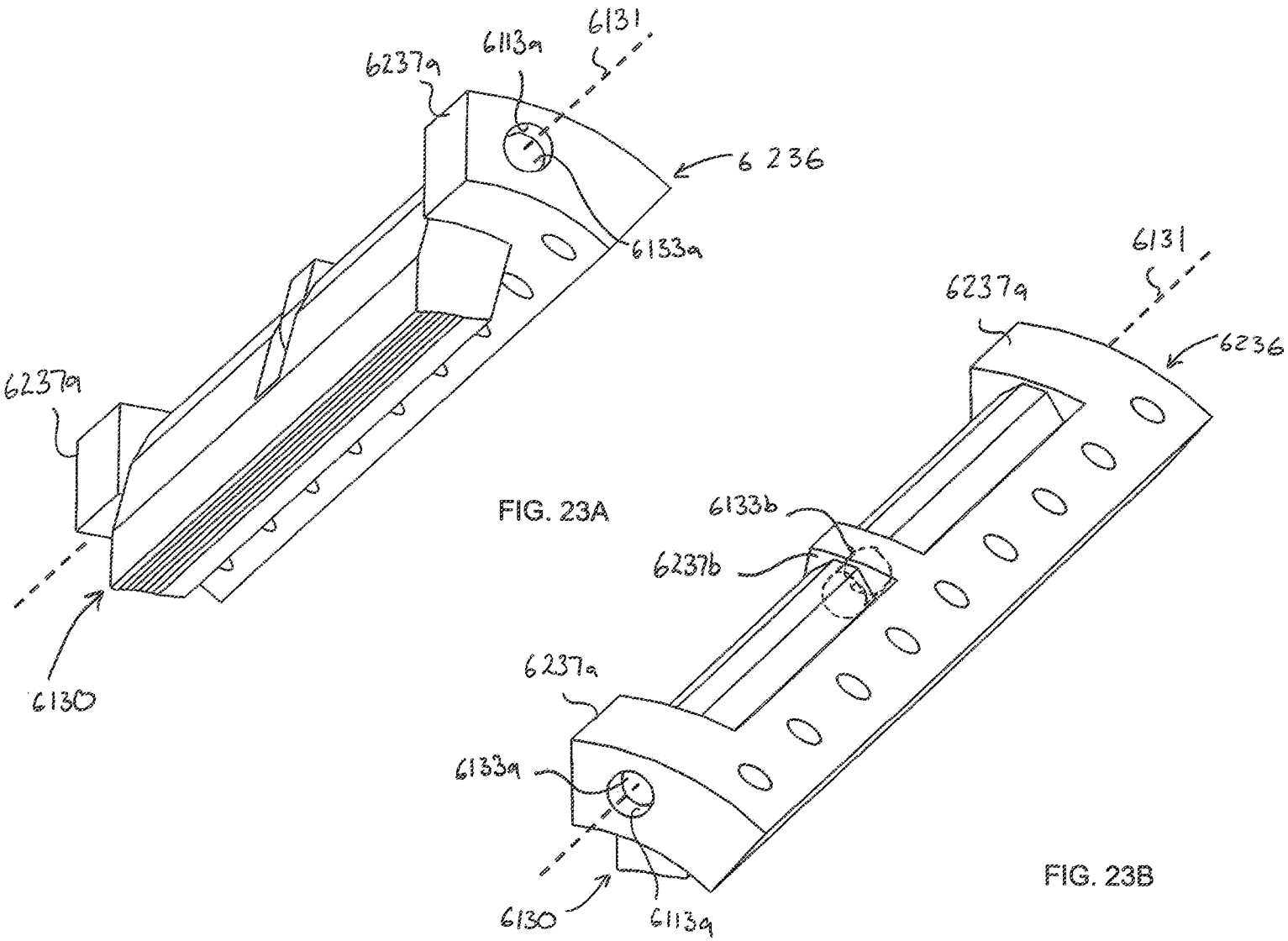
FIG. 23A is a perspective view of portions of another stator structure for use with a motor like that of FIG. 19A.
FIG. 23B is another perspective view of the portions of the stator structure of FIG. 23A.

Referring to FIGS. 23A and 23B, an example of another stator vane 6130 and stator block 6236 is illustrated. The stator vane 6130 has similarities to the stator vane 4130, and like features are identified by like reference characters, incremented by 2000. The stator block 6236 has similarities to the stator block 4236, and like features are identified by like reference characters, incremented by 2000.

In the example illustrated, the stator block 6236 can be fixed relative to the casing via a plurality of stator block bolts passing radially through the stator block 6236 and anchored in the motor casing.

In the example illustrated, the stator vane 6130 is pivotally supported by the stator block 6236 for pivoting about the stator vane axis 6131. The stator vane 6130 includes outboard pins 6133*a* (one of which is shown in FIG. 23A) extending outwardly from axial endfaces of the stator vane 6130 along the stator vane axis 6131. The outboard pins 6133*a* are received in stator vane apertures 6113*a* (one of which is shown in FIG. 23A) in axially spaced apart outboard end walls 6237*a* of the stator block 6236.

In the example illustrated, the stator vane 6130 further includes at least one inboard pin 6133*b* (shown in phantom lines in FIG. 23B) extending along the stator vane axis 6131 across a recess of the stator vane 6130. The inboard pin 6133*b* is received in a stator vane aperture in an inboard wall 6237*b* axially intermediate the outboard end walls 6237*a*. This can provide an increased number of anchor points for the stator vane 6130, can facilitate use of smaller pins, and can provide clearance for other components of the motor. This can also facilitate use of vanes having an increased length, and can increase the locking torque capacity and torque output and reduce the speed of the motor for a given flow rate and pressure. In some examples, the outboard pins 6133*a* and the inboard pin 6133*b* are of integral, unitary one-piece construction. In some examples, the outboard pins 6133*a* and the inboard pin 6133*b* comprise a unitary rod extending axially through an entirety of the stator vane 6140.

Figure 24:
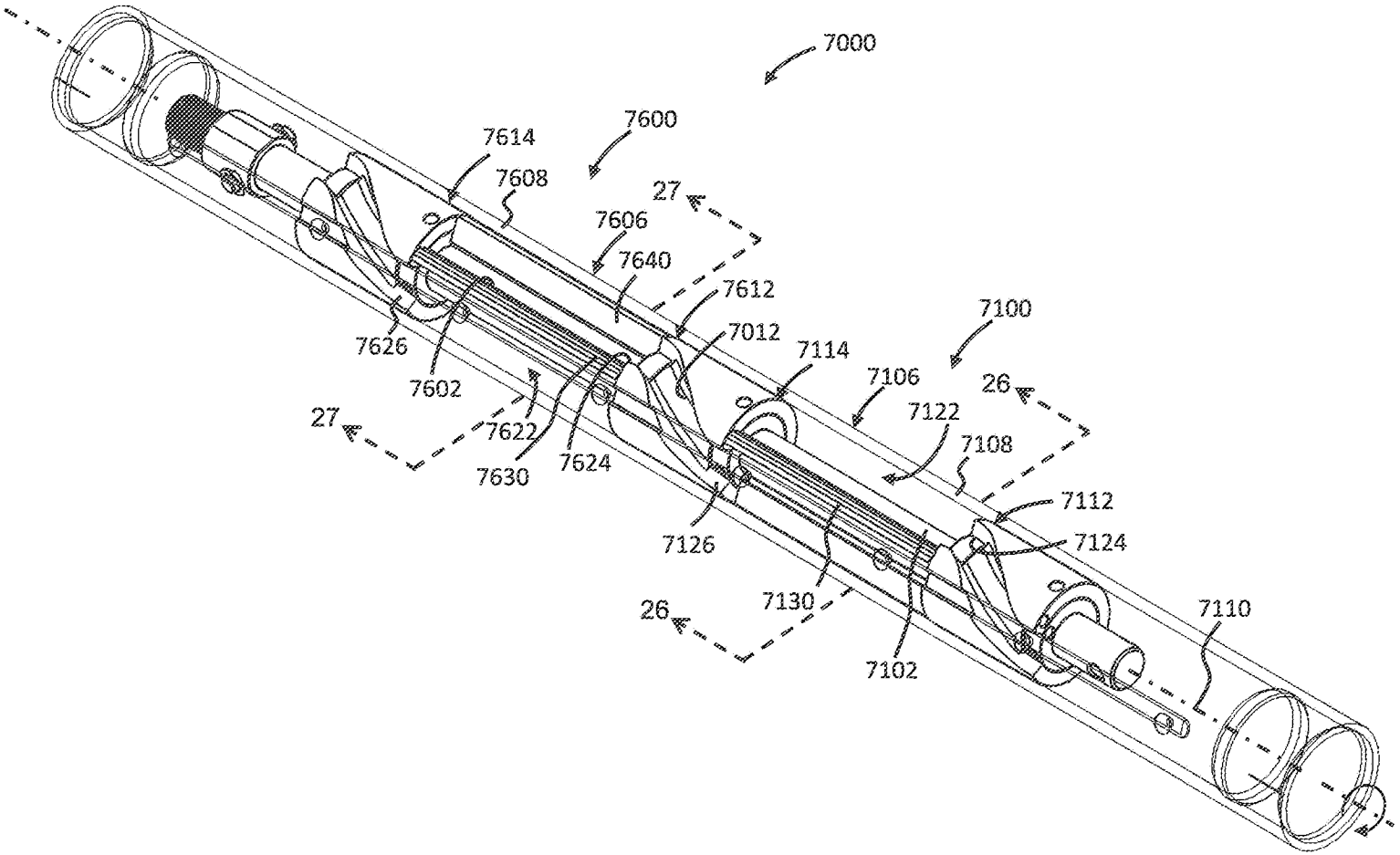
FIG. 24 is a perspective view of another rotary motor taken from an upstream end of the motor.

Referring to FIG. 24, an example of a rotary motor assembly 7000 is shown. The motor assembly 7000 includes a rotary first motor 7100 and a rotary second motor 7600 stacked in series, with the second motor 7600 downstream of the first motor 7100. Each of the first and second motors 7100, 7600 has similarities to the motor 100, and like features are identified by like reference characters, incremented by 7000 and 7500, respectively.

In the example illustrated, the first and second motors 7100, 7600 are circumferentially offset from one another, such that when the rotor and stator vanes of one of the first and second motors 7100, 7600 are in respective open positions (i.e. the rotor vanes are moving past the stator vanes), the rotor and stator vanes of the other one of the first and second motors 7100, 7600 are in respective closed positions and generating torque on the shaft to rotate the shaft in the power direction (and move the open rotor vanes circumferentially past the open stator vanes so that those rotor and stator vanes can pivot to respective closed positions).

In the example illustrated, the first motor 7100 includes a housing 7106 having a cylindrical casing 7108 (shown in phantom lines in FIG. 24) extending along a drive axis 7110 between axially spaced apart upstream and downstream end caps 7112, 7114. In the example illustrated, the first motor 7100 includes a shaft 7102 rotatably mounted within the housing 7106 and rotatable about the drive axis 7110. In the example illustrated, the shaft 7102 of the first motor 7100 is rotatably supported by a first set of plain bearing assemblies 7116 (FIG. 25) mounted in the housing 7106.

Figure 25:
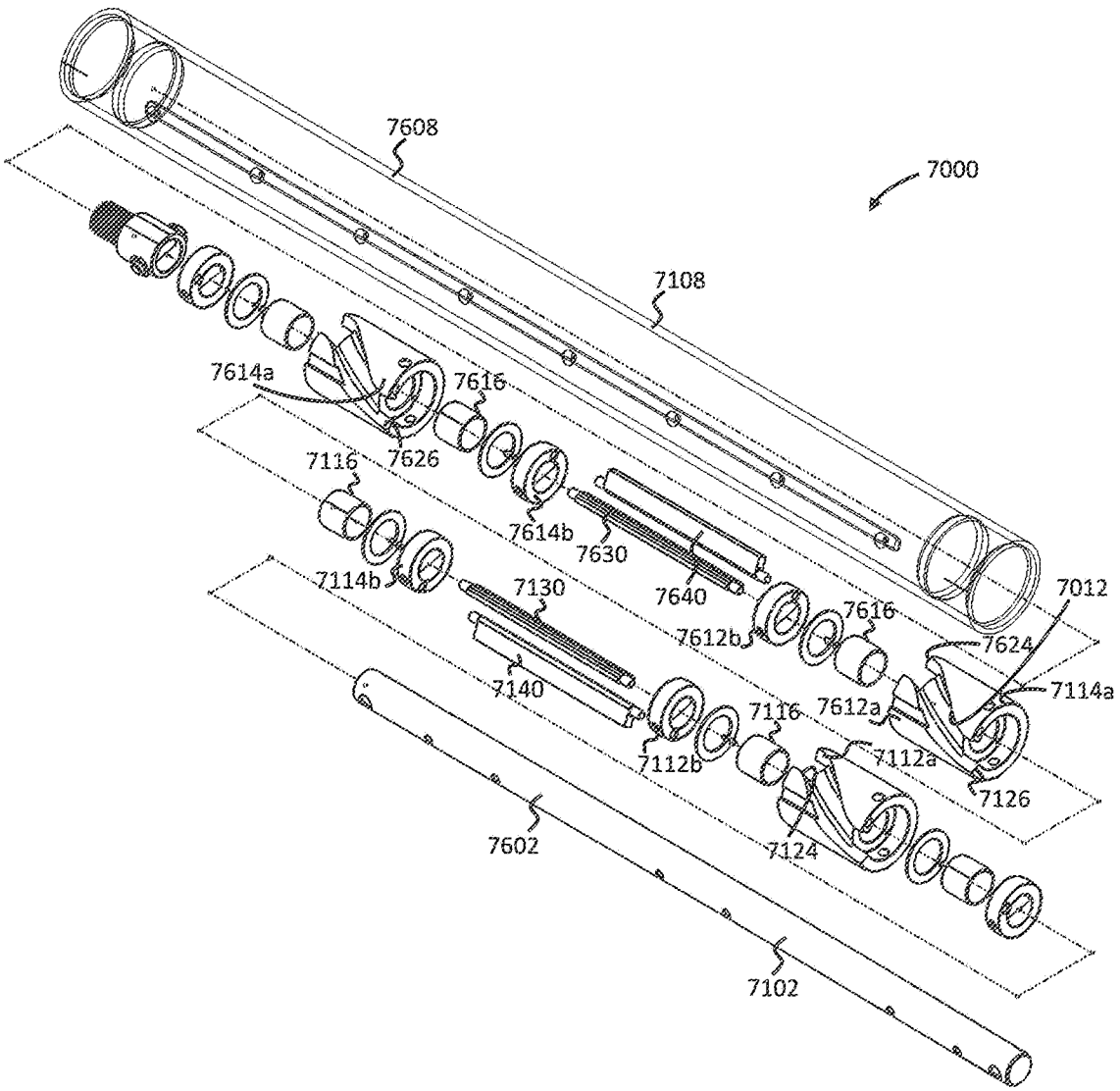
FIG. 25 is an exploded view of the motor of FIG. 24.

Referring to FIG. 25, in the example illustrated, the upstream end cap 7112 (FIG. 24) includes an upstream stator disc 7112*a* and an upstream rotor disc 7112*b*, and the downstream end cap 7114 (FIG. 24) includes a downstream stator disc 7114*a* and a downstream rotor disc 7114*b*. At least one inlet 7124 extends through the upstream end cap 7112 for conducting fluid into an annular passage 7122 (FIG. 24) within the housing 7106 of the first motor 7100. In the example illustrated, the inlet 7124 extends through and is fixed relative to the upstream stator disc 7112*a*. At least one outlet 7126 extends through the downstream end cap 7114 for evacuating fluid from the annular passage 7122 (FIG. 24) of the first motor 7100. In the example illustrated, the outlet 7126 extends through and is fixed relative to the downstream stator disc 7114*a*.

Figure 26:
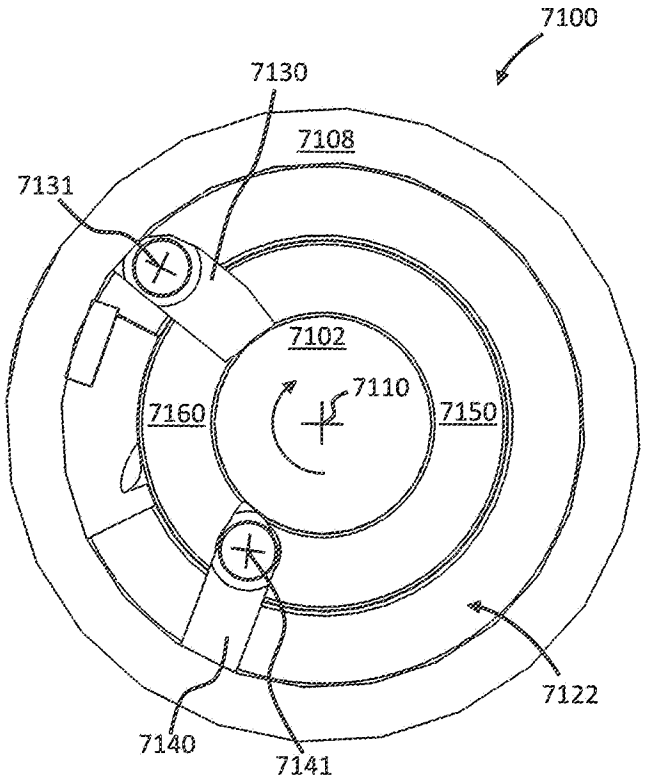
FIG. 26 is a cross-sectional view of the motor of FIG. 24 taken along line 26-26 of FIG. 24.

Referring to FIG. 26, in the example illustrated, the first motor 7100 includes a stator vane 7130 and a rotor vane 7140, each pivotable about a respective vane axis 7131, 7141 between respective open and closed positions. When in respective closed positions, the stator and rotor vanes 7130, 7140 separate the passage 7122 into a circumferentially expanding chamber 7150 in fluid communication with the inlet 7124 for receiving pressurized fluid, and a circumferentially collapsing chamber 7160 in fluid communication with the outlet 7126 for evacuating fluid.

Referring again to FIG. 24, in the example illustrated, the second motor 7600 includes a housing 7606 having a cylindrical casing 7608 (shown in phantom lines in FIG. 24) extending along the drive axis 7110 between axially spaced apart upstream and downstream end caps 7612, 7614. In the example illustrated, the casing 7108 of the first motor 7100 and the casing 7608 of the second motor 7600 are of integral, unitary one-piece construction.

In the example illustrated, the second motor 7600 includes a shaft 7602 rotatably mounted within the housing 7606 of the second motor 7600 and rotatable about the drive axis 7110. In the example illustrated, the shaft 7602 of the second motor 7600 is rotatably supported by a second set of plain bearing assemblies 7616 (FIG. 25) mounted in the housing 7606. In the example illustrated, the shaft 7102 of the first motor 7100 and the shaft 7602 of the second motor 7600 are of integral, unitary one-piece construction.

In the example illustrated, at least one inlet 7624 extends through the upstream end cap 7612 of the second motor 7600 for conducting fluid into an annular passage 7622 within the housing 7606 of the second motor 7600. At least one outlet 7626 extends through the downstream end cap 7614 of the second motor 7600 for evacuating fluid from the annular passage 7622.

Figure 27:
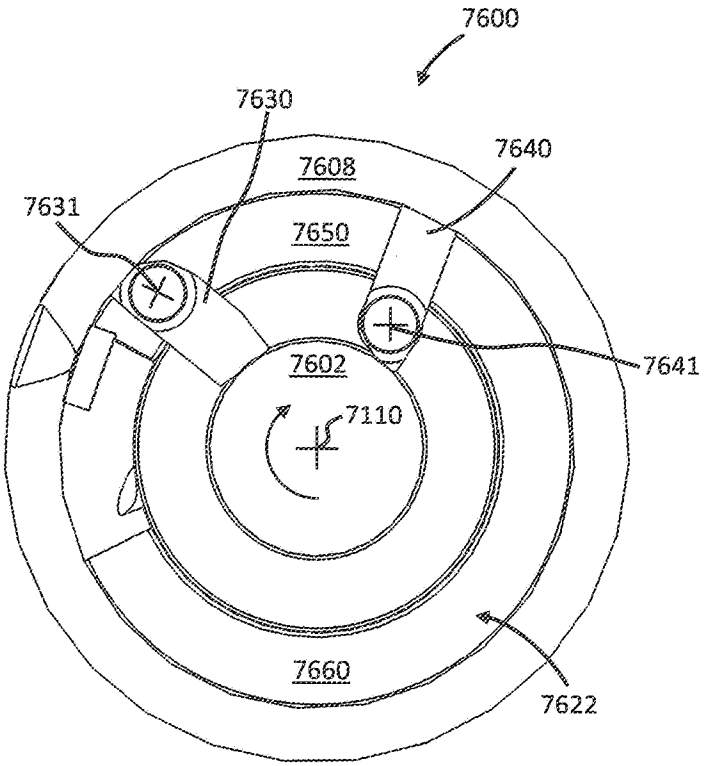
FIG. 27 is a cross-sectional view of the motor of FIG. 24 taken along line 27-27 of FIG. 24.

Referring to FIG. 27, in the example illustrated, the second motor 7600 includes a stator vane 7630 and a rotor vane 7640, each pivotable about a respective vane axis 7631, 7641 between respective open and closed positions. When in respective closed positions, the stator and rotor vanes 7630, 7640 separate the passage 7622 into a circumferentially expanding chamber 7650 in fluid communication with the inlet 7624 for receiving pressurized fluid, and a circumferentially collapsing chamber 7660 in fluid communication with the outlet 7626 for evacuating fluid.

Referring to FIGS. 26 and 27, in the example illustrated, the stator vane axis 7131 of the first motor 7100 is collinear with the stator vane axis 7631 of the second motor 7600, and the rotor vane axis 7141 of the first motor 7100 and the rotor vane axis 7641 of the second motor 7600 are spaced circumferentially apart about the drive axis 7110. This can facilitate continuous torque output by providing a stacked motor configuration in which at any given angular position of the unitary shafts 7102, 7602, at least one of the first and second motors 7100, 7600 can have rotor and stator vanes in respective closed positions for generating torque on the unitary shafts 7102, 7602. In the example illustrated, the rotor vane axis 7141 of the first motor 7100 and the rotor vane axis 7641 of the second motor 7600 are spaced equally apart about the drive axis 7110 (by 180 degrees in the example illustrated).

Referring to FIG. 25, in the example illustrated, the upstream end cap 7612 (FIG. 24) of the second motor 7600 includes an upstream stator disc 7612*a* and an upstream rotor disc 7612*b*, and the downstream end cap 7614 (FIG. 24) of the second motor 7600 includes a downstream stator disc 7614*a* and a downstream rotor disc 7614*b*. In the example illustrated, the inlet 7624 extends through and is fixed relative to the upstream stator disc 7612*a*. In the example illustrated, the outlet 7626 extends through and is fixed relative to the downstream stator disc 7614*a*. In the example illustrated, the downstream stator disc 7114*a* of the first motor 7100 and the upstream stator disc 7612*a* are of integral, unitary one-piece construction.

Referring to FIG. 24, in the example illustrated, fluid evacuated from the annular passage 7122 of the first motor 7100 is conducted into the annular passage 7622 of the second motor 7600. Referring to FIG. 25, in the example illustrated, an inter-motor duct 7012 extends axially through the unitary stator discs 7114*a*, 7612*a* between the outlet 7126 of the first motor 7100 and the inlet 7624 of the second motor 7600 for conducting fluid evacuated from the collapsing chamber 7160 of the first motor into the expanding chamber 7650 of the second motor 7600.

In the example illustrated, the inter-motor duct 7012 is radially intermediate outer surfaces of the unitary stator discs 7114*a*, 7612*a* and inner surfaces of the unitary casings 7108, 7608. In the example illustrated, the outlet 7126 of the first motor 7100 and the inlet 7124 of the second motor 7600 are circumferentially offset from one another and disposed on circumferentially opposite sides of the stator vane axes 7131, 7631, and the inter-motor duct 7012 extends helically about the drive axis 7110 therebetween.

Figure 28:
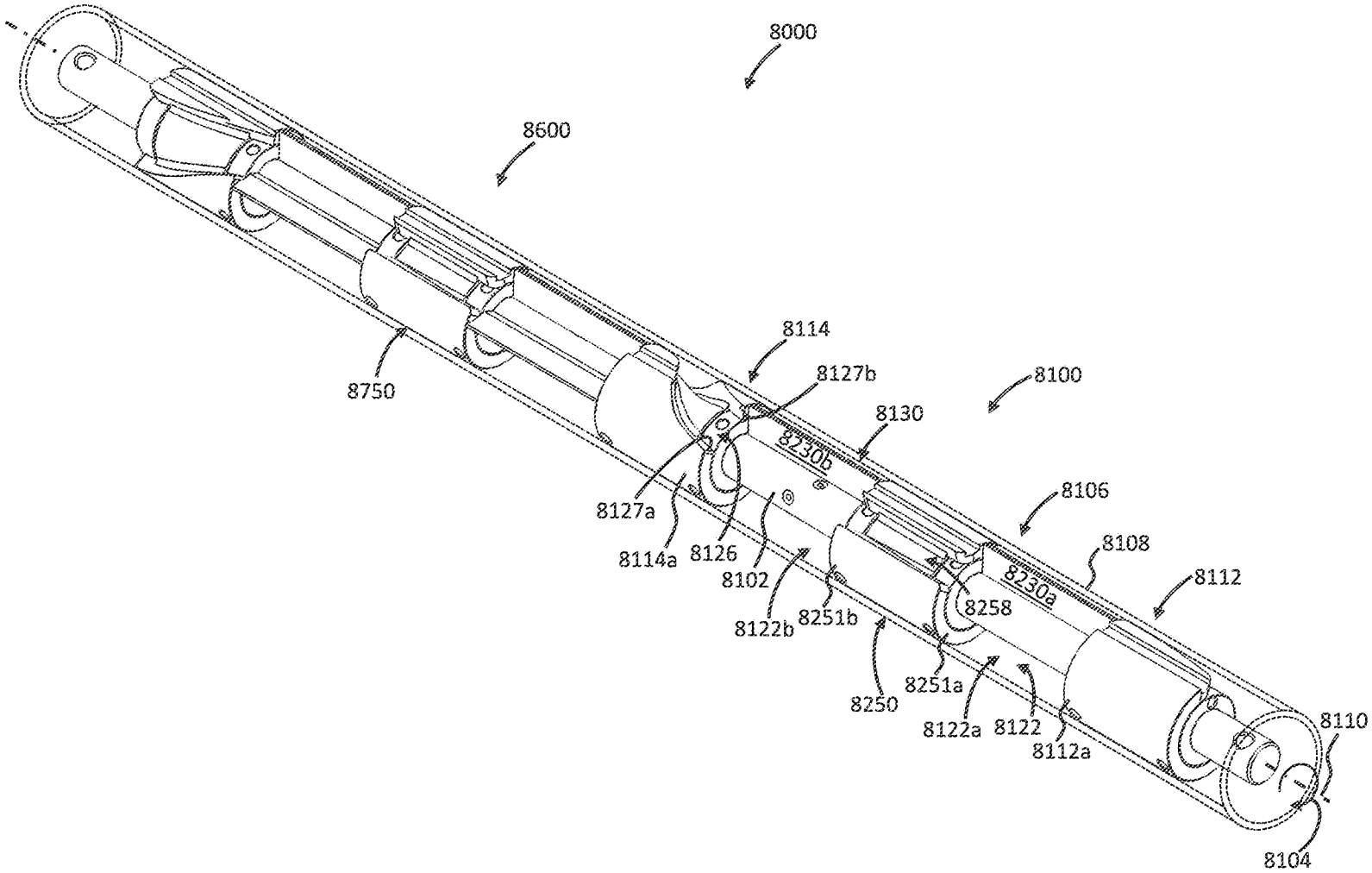
FIG. 28 is a perspective view of another rotary motor taken from an upstream end of the motor.
Figure 29:
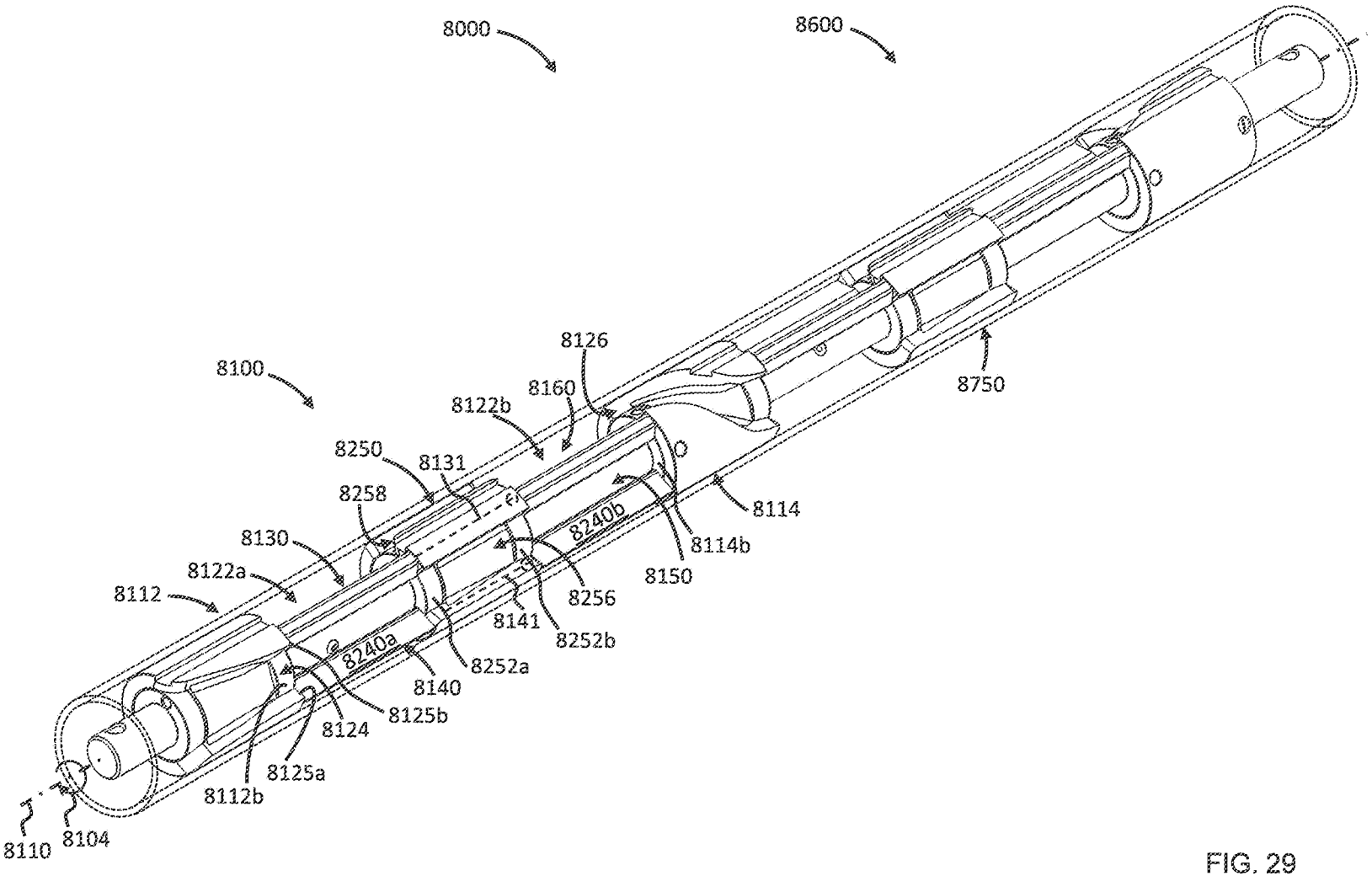
FIG. 29 is another perspective view of the motor of FIG. 28 taken from the upstream end of the motor.

Referring to FIGS. 28 and 29, an example of a rotary motor assembly 8000 is shown. The rotary motor assembly 8000 is similar to the rotary motor assembly 7000, and like features are identified by like reference characters, incremented by 1000.

In the example illustrated, the motor assembly 8000 includes a first motor 8100 and a second motor 8600 stacked in series. The first motor 8100 includes a housing 8106 a cylindrical casing 8108 (shown in phantom lines in FIG. 28) extending along a drive axis 8110 between axially spaced apart upstream and downstream end caps 8112, 8114. A shaft 8102 is rotatably mounted within the housing 8106 and rotatable about the drive axis 8110.

Referring to FIG. 29, in the example illustrated, the first motor 8100 includes a stator vane 8130 and a rotor vane 8140, each pivotable about a respective vane axis 8131, 8141 (shown in phantom lines in FIG. 29) between respective open and closed positions. When in respective closed positions, the stator and rotor vanes 8130, 8140 separate an annular passage 8122 (FIG. 28) within the housing 8106 into a circumferentially expanding chamber 8150 in fluid communication with an inlet 8124 for receiving pressurized fluid, and a circumferentially collapsing chamber 8160 in fluid communication with an outlet 8126 for evacuating fluid.

The inventors have discovered that increasing the length of the stator and rotor vanes 8130, 8140 results in a corresponding increase in torque output, but also increased deflection of the stator and rotor vanes 8130, 8140 and stress on the pins pivotally supporting the vanes 8130, 8140. To help avoid these problems, but still achieve a desired torque output, a vane support 8250 can be provided in the passage 8122 for providing an axially intermediate support to the stator and rotor vanes 8130, 8140.

Referring to FIG. 28, in the example illustrated, the vane support 8250 separates the passage 8122 into a passage upstream portion 8122*a* and a passage downstream portion 8122*b* axially downstream of the passage upstream portion 8122*a*. In the example illustrated, the stator vane 8130 includes a stator vane upstream portion 8230*a* extending axially across the passage upstream portion 8122*a*. The stator vane upstream portion 8230*a* extends axially between an upstream end pivotally supported by an upstream stator disc 8112*a* of the upstream end cap 8112, and a downstream end pivotally supported by a first support stator disc 8251*a* of the vane support 8250. The stator vane 8130 further includes a stator vane downstream portion 8230*b* extending axially across the passage downstream portion 8122*b*. The stator vane downstream portion 8230*b* extends axially between an upstream end pivotally supported by a second support stator disc 8251*b* of the vane support 8250 and a downstream end pivotally supported by a downstream stator disc 8114*a* of the downstream end cap 8114. In the example illustrated, the first and second support stator discs 8251*a*, 8251*b* are of integral, unitary one-piece construction.

Referring to FIG. 29, in the example illustrated, the rotor vane 8140 includes a rotor vane upstream portion 8240*a* extending axially across the passage upstream portion 8122*a*. The rotor vane upstream portion 8240*a* extends axially between an upstream end pivotally supported by an upstream rotor disc 8112*b* of the upstream end cap 8112, and a downstream end pivotally supported by a first support rotor disc 8252*a* of the vane support 8250. The rotor vane 8140 further includes a rotor vane downstream portion 8240*b* extending axially across the passage downstream portion 8122*b*. The rotor vane downstream portion 8240*b* extends axially between an upstream end pivotally supported by a second support rotor disc 8252*b* of the vane support 8250 and a downstream end pivotally supported by a downstream rotor disc 8114*b* of the downstream end cap 8114.

In the example illustrated, the expanding chamber 8150 comprises an expanding chamber duct 8256 extending axially through the vane support 8250 for providing fluid communication between the passage upstream portion 8122*a* and the passage downstream portion 8122*b*. In the example illustrated, the expanding chamber duct 8256 extends generally parallel to the drive axis 8110. In the example illustrated, the inlet 8124 has an inlet circumferential extent between an inlet leading edge 8125*a* spaced circumferentially apart from the stator vane axis 8131 in a power direction 8104, and an inlet trailing edge 8125*b* circumferentially intermediate the inlet leading edge 8125*a* and the stator vane axis 8131. In the example illustrated, the expanding chamber duct 8256 is circumferentially intermediate the inlet leading edge 8125*a* and the inlet trailing edge 8125*b*.

Referring to FIG. 28, in the example illustrated, the collapsing chamber 8160 comprises a collapsing chamber duct 8258 extending axially through the vane support 8250 for providing fluid communication between the passage upstream portion 8122*a* and the passage downstream portion 8122*b*. In the example illustrated, the collapsing chamber duct 8258 extends generally parallel to the drive axis 8110. In the example illustrated, the outlet 8126 has an outlet circumferential extent between an outlet trailing edge 8127*a* spaced circumferentially apart from the stator vane axis 8131 (FIG. 29) in a reverse direction opposite the power direction 8104, and an outlet leading edge 8127*b* circumferentially intermediate the outlet trailing edge 8127*a* and the stator vane axis 8131 (FIG. 29). In the example illustrated, the collapsing chamber duct 8258 is circumferentially intermediate the outlet trailing edge 8127*a* and the outlet leading edge 8127*b*.

In the example illustrated, the second motor 8600 includes a vane support 8750 similar to the vane support 8250 of the first motor 8100.

Figure 30:
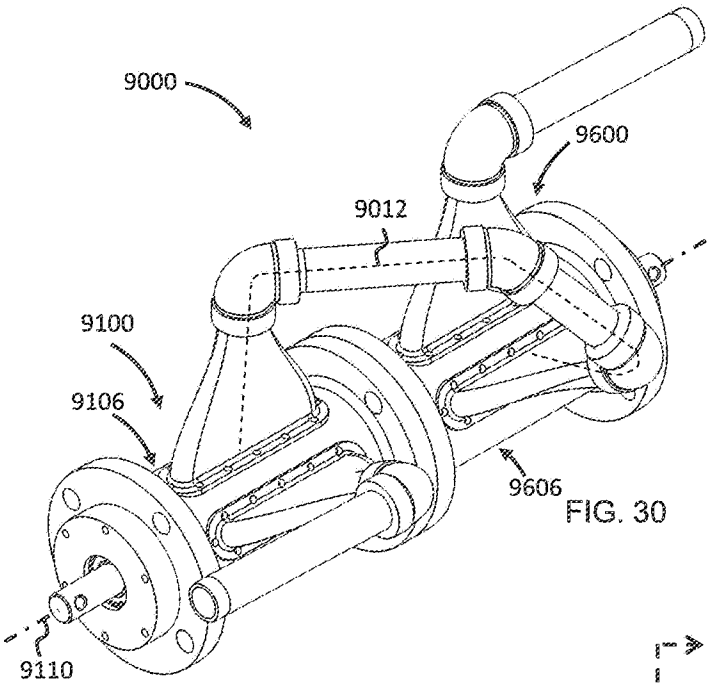
FIG. 30 is a perspective view of a rotary pump taken from an upstream end of the pump.
Figure 31:
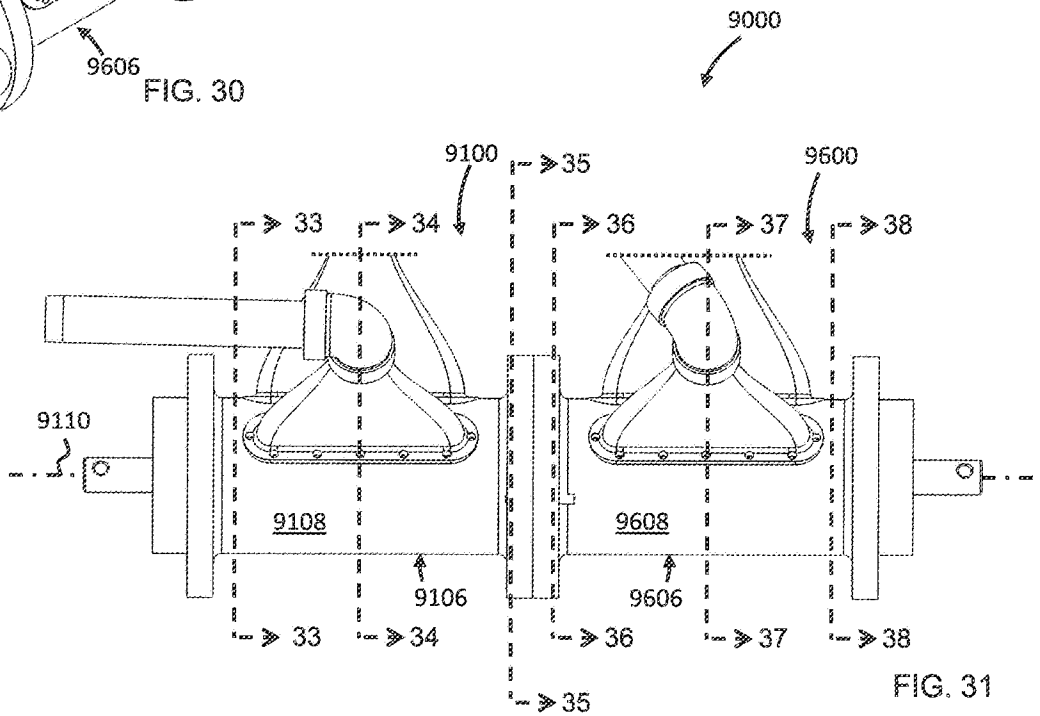
FIG. 31 is a side view of the pump of FIG. 30.

Referring to FIGS. 30 and 31, an example rotary pump assembly 9000 is illustrated. The pump assembly 9000 has similarities to the motor assembly 7000 and like features are identified by like reference characters, incremented by 2000.

In the example illustrated, the pump assembly 9000 includes a rotary first pump 9100 and a rotary second pump 9600 stacked in series.

Figure 32:
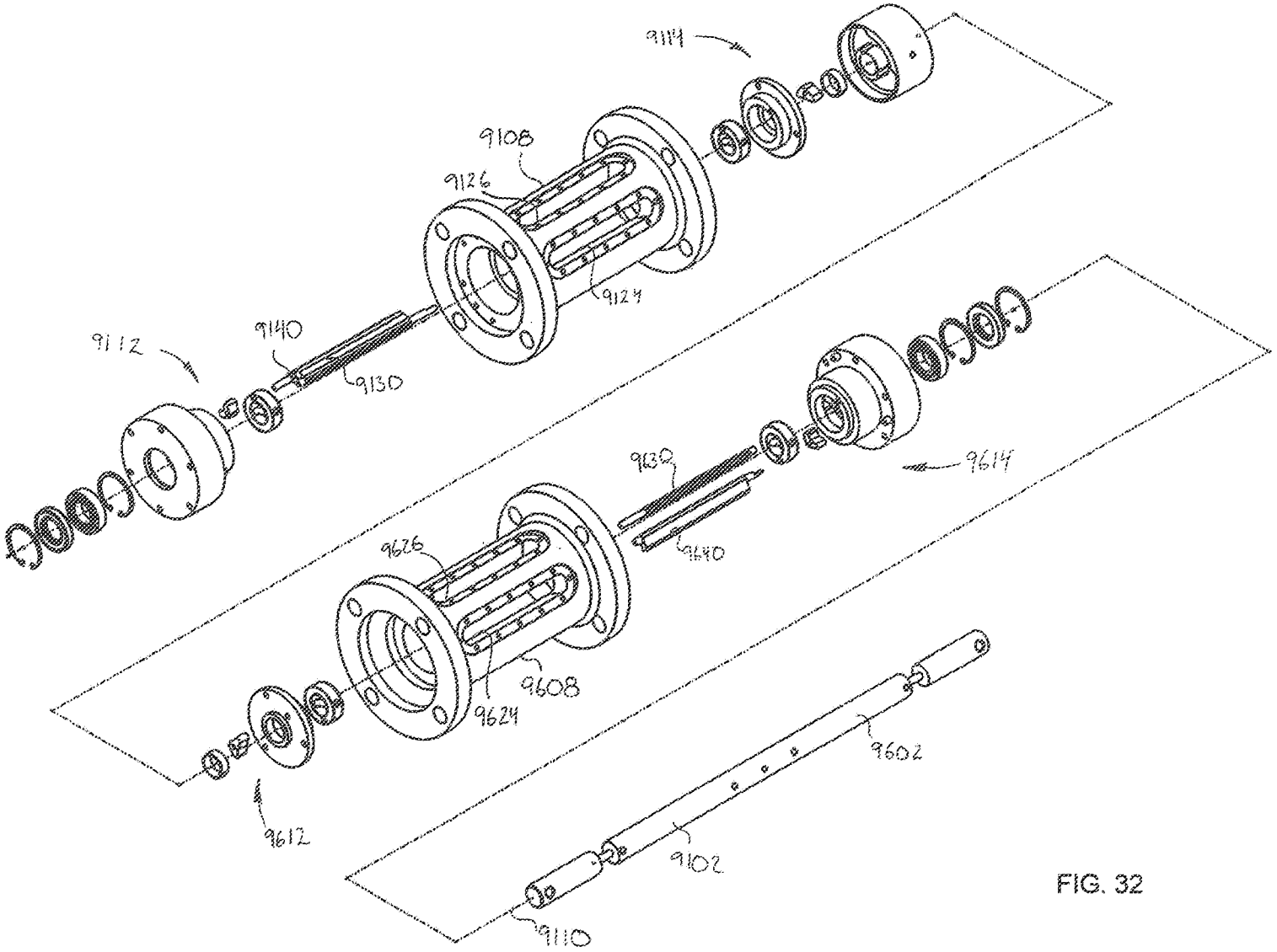
FIG. 32 is an exploded view of portions of the pump of FIG. 30.

In the example illustrated, the first pump 9100 includes a housing 9106 having a cylindrical casing 9108 extending along a drive axis 9110 between axially spaced apart upstream and downstream end caps 9112, 9114 (FIG. 32). Referring to FIG. 32, a shaft 9102 is rotatably mounted within the housing 9106 and rotatable relative to the casing 9108 about the drive axis 9110.

Figure 33:
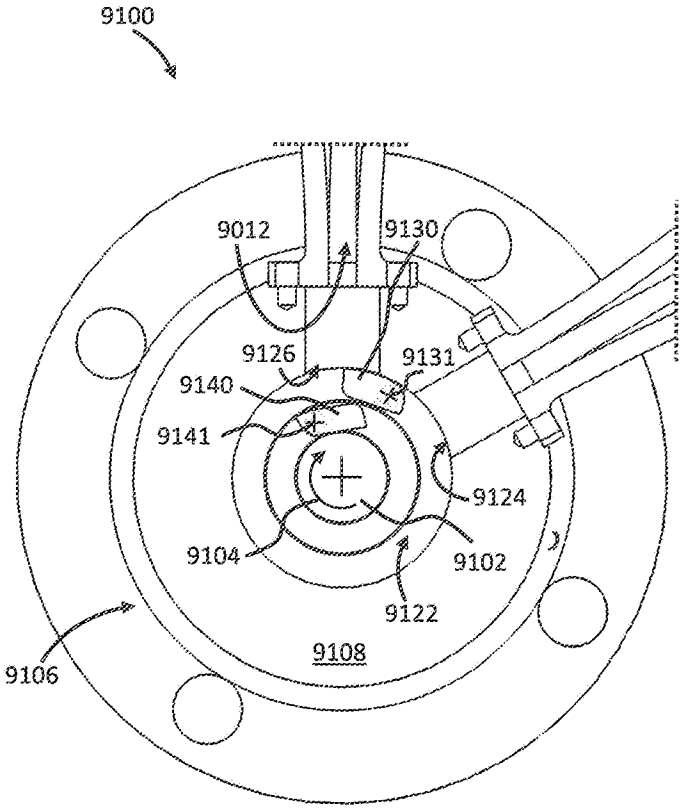
FIG. 33 is a cross-sectional view of the pump of FIG. 30 taken along line 33-33 of FIG. 31.

Referring to FIG. 33, in the example illustrated, the first pump 9100 includes an annular passage 9122 within the housing 9106. The annular passage 9122 is radially intermediate the shaft 9102 and the casing 9108 and bounded axially by the end caps 9112, 9114.

In the example illustrated, the first pump 9100 includes an inlet 9124 in the housing 9106 for conducting fluid into the annular passage 9122, and an outlet 9126 in the housing 9106 for evacuating fluid from the annular passage 9122. In the example illustrated, the inlet 9124 and the outlet 9126 are spaced circumferentially apart, and each extends radially through and is fixed relative to the casing 9108.

In the example illustrated, the first pump 9100 includes a stator vane 9130 extending axially across the passage 9122. The stator vane 9130 is pivotable about a stator vane axis 9131 fixed relative to the casing 9108 between a stator vane closed position for inhibiting circumferential fluid flow in the passage 9122 across the stator vane 9130, and a stator vane open position (shown in FIG. 33). The inlet 9124 and the outlet 9126 are disposed on circumferentially opposite sides of the stator vane axis 9131.

In the example illustrated, the first pump 9100 includes a rotor vane 9140 extending axially across the passage 9122. The rotor vane 9140 is pivotable about a rotor vane axis 9141 fixed relative to the shaft 9102 between a rotor vane closed position for inhibiting circumferential fluid flow in the passage 9122 across the rotor vane 9140, and a rotor vane open position (shown in FIG. 33).

Figure 36:
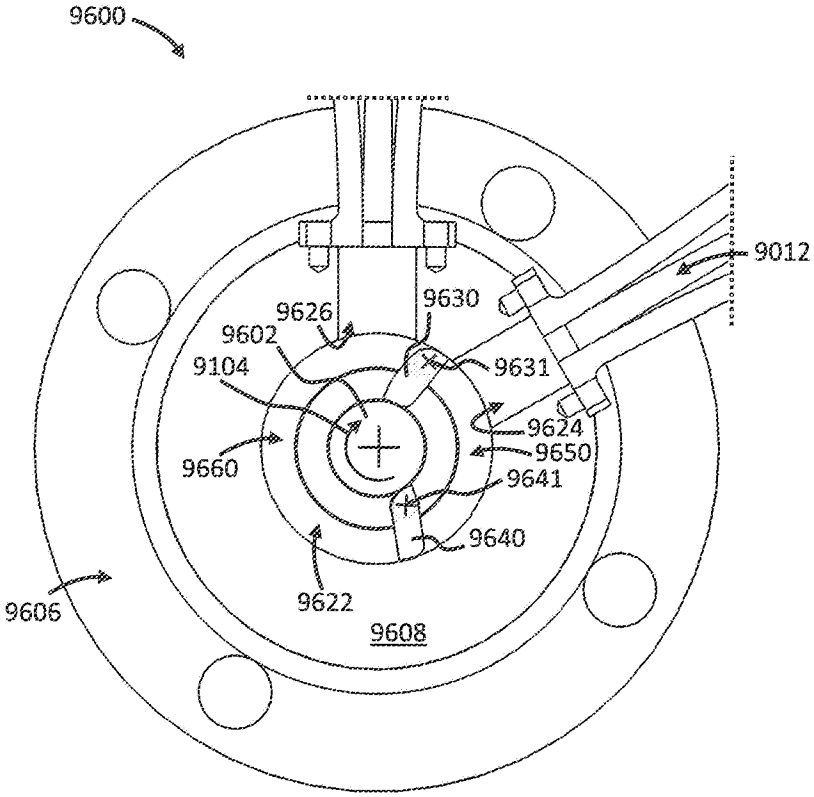
FIG. 36 is a cross-sectional view of the pump of FIG. 30 taken along line 36-36 of FIG. 31.

Still referring to FIG. 33, when the rotor and stator vanes 9130, 9140 are in respective open positions, the rotor vane 9140 is movable circumferentially past the stator vane 9130 during rotation of the shaft 9102 in the power direction 9104. When in respective closed positions, the stator and rotor vanes 9130, 9140 separate the passage 9122 into a circumferentially expanding chamber and a circumferentially collapsing chamber spaced circumferentially apart from the expanding chamber (see FIG. 36 showing stator and rotor vanes of the second pump 9600 in respective closed positions). The expanding chamber is in fluid communication with the inlet 9124 for drawing fluid into the expanding chamber during rotation of the shaft 9102 in the power direction 9104. The collapsing chamber is in fluid communication with the outlet 9126 for discharging pressurized fluid from the collapsing chamber during rotation of the shaft 9102 in the power direction 9104.

In some examples, the inlet 9124 can include a one-way fluid check valve for permitting flow of fluid into the expanding chamber through the inlet 9124 and blocking flow of fluid out from the expanding chamber through the inlet 9124. In some examples, the outlet 9126 can include a one-way fluid check valve for permitting flow of fluid out from the collapsing chamber through the outlet 9126 and blocking flow of fluid into the collapsing chamber through the outlet 9126.

In the example illustrated, the first pump 9100 includes a vane pivoting mechanism for urging the stator and rotor vanes 9130, 9140 to pivot from respective closed positions to respective open positions when the shaft 9102 rotates through at least one predetermined angular position. In some examples, rotation of the shaft and fluid flow dynamics may be sufficient to pivot one or both of the stator and rotor vanes 9130, 9140 from respective open positions back to respective closed positions after the rotor vane 9140 passes the stator vane 9130. Optionally, the vane pivoting mechanism can urge one or both of the stator and rotor vanes 9130, 9140 to pivot from respective open positions toward respective closed positions after the rotor vane 9140 passes the stator vane 9130.

Figure 34:
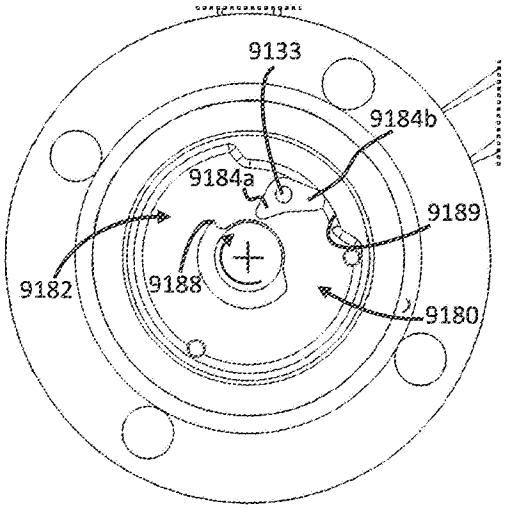
FIG. 34 is a cross-sectional view of the pump of FIG. 30 taken along line 34-34 of FIG. 31.
Figure 37:
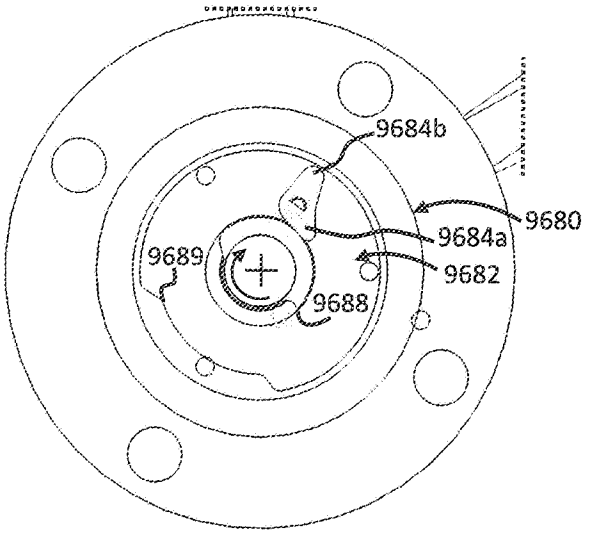
FIG. 37 is a cross-sectional view of the pump of FIG. 30 taken along line 37-37 of FIG. 31.

Referring to FIG. 34, in the example illustrated, the vane pivoting mechanism includes a stator vane pivoting mechanism 9180 for pivoting the stator vane 9130 between the stator vane open and closed positions. The stator vane pivoting mechanism 9180 includes a stator vane actuator 9182 and a pair of stator vane first and second crank arms 9184*a*, 9184*b* fixed to and extending radially from a stator vane pin 9133 of the stator vane 9130. In the example illustrated, the stator vane actuator 9182 includes a stator vane first cam surface 9188 fixed to rotate with the shaft 9102 for engaging the stator vane first crank arm 9184*a* to urge the stator vane 9130 toward the stator vane closed position (see FIG. 37 showing the stator vane first cam surface of the second pump 9600 in engagement with the stator vane first crank arm of the second pump 9600). The stator vane actuator 9182 further includes a stator vane second cam surface 9189 fixed to rotate with the shaft 9102 for engaging the stator vane second crank arm 9184*b* to urge the stator vane 9130 toward the stator vane open position (see FIGS. 33 and 34).

Figure 35:
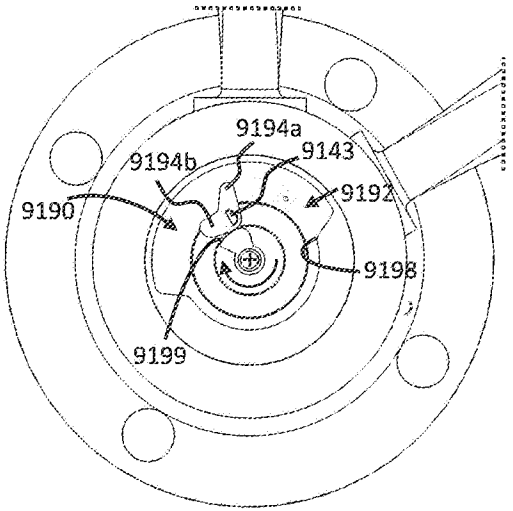
FIG. 35 is a cross-sectional view of the pump of FIG. 30 taken along line 35-35 of FIG. 31.
Figure 38:
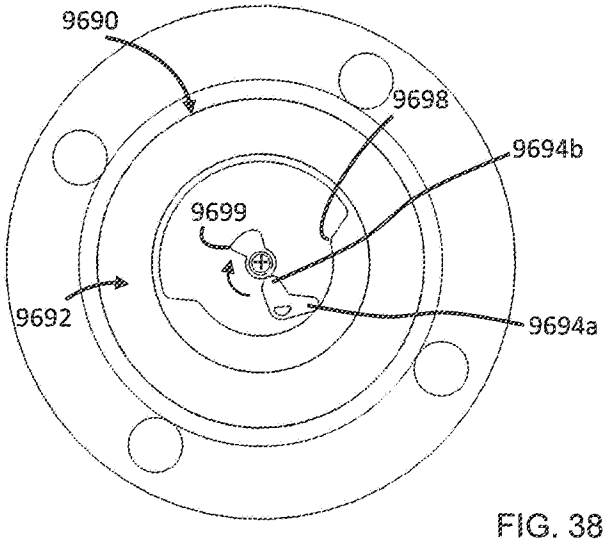
FIG. 38 is a cross-sectional view of the pump of FIG. 30 taken along line 38-38 of FIG. 31.

Referring to FIG. 35, in the example illustrated, the vane pivoting mechanism further includes a rotor vane pivoting mechanism 9190 for pivoting the rotor vane 9140 between the rotor vane open and closed positions. The rotor vane pivoting mechanism 9190 includes a rotor vane actuator 9192 and a pair of rotor vane first and second crank arms 9194*a*, 9194*b* fixed to and extending radially from a rotor vane pin 9143 of the rotor vane 9140. In the example illustrated, the rotor vane actuator 9192 includes a rotor vane first cam surface 9198 fixed relative to the casing 9108 for engaging the rotor vane first crank arm 9194*a* to urge the rotor vane 9140 toward the rotor vane closed position (see FIG. 38 showing the rotor vane first cam surface of the second pump 9600 in engagement with the rotor vane first crank arm of the second pump 9600). The rotor vane actuator 9192 further includes a rotor vane second cam surface 9199 fixed relative to the casing 9108 for engaging the rotor vane second crank arm 9194*b* to urge the rotor vane 9140 toward the rotor vane open position (see FIGS. 33 and 35).

Referring to FIG. 32, the second pump 9600 is similar to the first pump 9100, and like features are identified by like reference characters, incremented by 500. In the example illustrated, the second pump 9600 includes a housing 9606 (FIG. 30) having a cylindrical casing 9608 extending along the drive axis 9110 between axially spaced apart upstream and downstream end caps 9612, 9614. In the example illustrated, the second pump 9600 includes a shaft 9602 rotatably mounted within the housing 9606 and rotatable about the drive axis 9110.

Referring to FIG. 36, in the example illustrated, the second pump 9600 includes a stator vane 9630 and a rotor vane 9640, each pivotable about a respective vane axis 9631, 9641 between respective open and closed positions. When in respective closed positions, the stator and rotor vanes 9630, 9640 separate the passage 9622 into a circumferentially expanding chamber 9650 in fluid communication with an inlet 9624 for drawing fluid into the expanding chamber 9650, and a circumferentially collapsing chamber 9660 in fluid communication with an outlet 9626 for discharging pressurized fluid from the collapsing chamber 9660. When the rotor and stator vanes 9630, 9640 are in respective open positions, the rotor vane 9640 is movable circumferentially past the stator vane 9630 during rotation of the shaft 9602 in the power direction 9104 (see FIG. 33 showing the stator and rotor vanes 9130, 9140 of the first pump 9100 in respective open positions).

Referring to FIG. 30, in the example illustrated, fluid evacuated from the annular passage 9122 of the first pump 9100 is conducted into the annular passage 9622 of the second pump 9600. In the example illustrated, an inter-pump duct 9012 (shown schematically in FIG. 30) extends between the outlet 9126 of the first pump 9100 and the inlet 9124 of the second pump 9600 for conducting fluid from the collapsing chamber of the first pump 9100 into the expanding chamber 9650 of the second pump 9600 (see also FIGS. 33 and 36). In the example illustrated, the inter-pump duct 9012 is external the casings 9108, 9608 of the first and second pumps 9100, 9600.

In the example illustrated, the second pump 9600 includes a vane pivoting mechanism for urging the stator and rotor vanes 9630, 9640 to pivot from respective closed positions to respective open positions at predetermined angular positions of the shaft 9602. Optionally, the vane pivoting mechanism can urge one or both of the stator and rotor vanes 9630, 9640 to pivot from respective open positions toward respective closed positions.

Referring to FIG. 37, the vane pivoting mechanism of the second pump 9600 includes a stator vane pivoting mechanism 9680 in the housing 9606 having a stator vane actuator 9682 and a pair of stator vane first and second crank arms 9684*a*, 9684*b*. The stator vane pivoting mechanism 9680 includes a stator vane first cam surface 9688 for engaging the stator vane first crank arm 9684*a* to urge the stator vane toward the closed position, and a stator vane second cam surface 9689 for engaging the stator vane second crank arm 9684*b* to urge the stator vane toward the open position.

Referring to FIG. 38, the vane pivoting mechanism further includes a rotor vane pivoting mechanism 9690 having a rotor vane actuator 9692 and a pair of rotor vane first and second crank arms 9694*a*, 9694*b*. In the example illustrated, the rotor vane actuator 9692 includes a rotor vane first cam surface 9698 for engaging the rotor vane first crank arm 9694*a* to urge the rotor vane 9640 toward the rotor vane closed position, and a rotor vane second cam surface 9699 for engaging the rotor vane second crank arm 9694*b* to urge the rotor vane 9640 toward the rotor vane open position.

The invention claimed is:

1. A rotary drive comprising:

a) a housing having a cylindrical casing extending along a drive axis between axially spaced apart first and second end caps;

b) a shaft rotatably mounted within the housing and rotatable relative to the casing about the drive axis;

c) an annular passage radially intermediate the shaft and the casing and bounded axially by the end caps;

d) at least one stator vane extending axially across the passage, the at least one stator vane pivotable about a stator vane axis fixed relative to the casing between a stator vane closed position for inhibiting circumferential fluid flow in the passage across the stator vane, and a stator vane open position;

e) at least one rotor vane extending axially across the passage, the at least one rotor vane pivotable about a rotor vane axis fixed relative to the shaft between a rotor vane closed position for inhibiting circumferential fluid flow in the passage across the rotor vane, and a rotor vane open position, f) wherein when in the closed positions, the stator and rotor vanes separate the passage into at least one circumferentially expanding chamber and at least one circumferentially collapsing chamber spaced circumferentially apart from the at least one expanding chamber, the at least one expanding chamber in fluid communication with at least one inlet in the housing for receiving fluid in the at least one expanding chamber, and the at least one collapsing chamber in fluid communication with at least one outlet in the housing for evacuating fluid from the at least one collapsing chamber, g) wherein when the rotor and stator vanes are in the open positions, the at least one rotor vane is movable circumferentially past the at least one stator vane during rotation of the shaft, and wherein the first end cap includes a first stator disc fixed relative to the casing and the second end cap includes a second stator disc fixed relative to the casing, and wherein the at least one stator vane extends axially between a first end pivotally supported by the first stator disc and a second end pivotally supported by the second stator disc.

2. The rotary drive of claim 1, further comprising a vane pivoting mechanism for pivoting at least one of the at least one stator vane and the at least one rotor vane in at least one direction between the open and closed positions when the shaft rotates through at least one predetermined angular position.

3. The rotary drive of claim 1, wherein the at least one stator vane has a stator vane height bounded by a stator vane root edge and an opposed stator vane tip edge, the stator vane root edge proximate the casing and the stator vane tip edge proximate the shaft when the at least one stator vane is in the stator vane closed position, and wherein the stator vane axis is intermediate the stator vane tip edge and the stator vane root edge.

4. The rotary drive of claim 3, further comprising a stator vane stop surface fixed to the stator vane and a stator abutment surface fixed relative to the casing, wherein the stator vane stop surfaces engages the stator abutment surface when the stator vane is in the stator vane closed position to inhibit further pivoting of the stator vane past the stator vane closed position.

5. The rotary drive of claim 4, wherein the stator vane stop surface comprises a portion of a stator vane trailing face of the stator vane disposed radially intermediate the stator vane axis and the stator vane tip edge.

6. The rotary drive of claim 1, wherein when the at least one stator vane is in the stator vane open position, the at least one stator vane is spaced radially apart from the casing by a stator vane flow gap for permitting circumferential fluid flow in the passage across the at least one stator vane.

7. The rotary drive of claim 1, wherein the at least one stator vane includes a stator vane first pin projecting axially from a first axial endface of the at least one stator vane, and a stator vane second pin projecting axially from an opposed second axial endface of the at least one stator vane, and wherein each of the stator vane first pin and the stator vane second pin is received in a respective aperture in the first stator disc and the second stator disc, respectively, for pivotally supporting the at least one stator vane.

8. The rotary drive of claim 1, wherein the at least one inlet extends axially through the first end cap, and the at least one outlet extends axially through the second end cap.

9. The rotary drive of claim 1, wherein at least one of the at least one outlet and the at least one inlet extends radially through the casing.

10. The rotary drive of claim 1, wherein the at least one rotor vane comprises at least two rotor vanes each pivotable about a respective rotor vane axis, and the at least one stator vane comprises at least two stator vanes each pivotable about a respective stator vane axis.

11. A rotary drive comprising:

a) a housing having a cylindrical casing extending along a drive axis between axially spaced apart first and second end caps;

b) a shaft rotatably mounted within the housing and rotatable relative to the casing about the drive axis;

c) an annular passage radially intermediate the shaft and the casing and bounded axially by the end caps;

d) at least one stator vane extending axially across the passage, the at least one stator vane pivotable about a stator vane axis fixed relative to the casing between a stator vane closed position for inhibiting circumferential fluid flow in the passage across the stator vane, and a stator vane open position;

e) at least one rotor vane extending axially across the passage, the at least one rotor vane pivotable about a rotor vane axis fixed relative to the shaft between a rotor vane closed position for inhibiting circumferential fluid flow in the passage across the rotor vane, and a rotor vane open position, f) wherein when in the closed positions, the stator and rotor vanes separate the passage into at least one circumferentially expanding chamber and at least one circumferentially collapsing chamber spaced circumferentially apart from the at least one expanding chamber, the at least one expanding chamber in fluid communication with at least one inlet in the housing for receiving fluid in the at least one expanding chamber, and the at least one collapsing chamber in fluid communication with at least one outlet in the housing for evacuating fluid from the at least one collapsing chamber, g) wherein when the rotor and stator vanes are in the open positions, the at least one rotor vane is movable circumferentially past the at least one stator vane during rotation of the shaft, and wherein the first end cap includes a first rotor disc fixed to rotate with the shaft and the second end cap includes a second rotor disc fixed to rotate with the shaft, and wherein the at least one rotor vane extends axially between a first end pivotally supported by the first rotor disc and a second end pivotally supported by the second rotor disc.

12. The rotary drive of claim 11, wherein the at least one rotor vane has a rotor vane height bounded by a rotor vane root edge and an opposed rotor vane tip edge, the rotor vane root edge proximate the shaft and the rotor vane tip edge proximate the casing when the at least one rotor vane is in the rotor vane closed position, and wherein the rotor vane axis is intermediate the rotor vane tip edge and the rotor vane root edge.

13. The rotary drive of claim 12, further comprising a rotor vane stop surface fixed to the rotor vane and a rotor abutment surface fixed relative to the shaft, wherein the rotor vane stop surface engages the rotor abutment surface when the rotor vane is in the rotor vane closed position to inhibit further pivoting of the rotor vane about the rotor vane axis past the rotor vane closed position.

14. The rotary drive of claim 13, wherein the rotor vane stop surface comprises a portion of a rotor vane leading face of the rotor vane disposed radially intermediate the rotor vane axis and the rotor vane tip edge.

15. The rotary drive of claim 11, wherein when the at least one rotor vane is in the rotor vane open position, the at least one rotor vane is spaced radially apart from the shaft by a rotor vane flow gap for permitting circumferential fluid flow in the passage across the at least one rotor vane.

16. The rotary drive of claim 11, wherein the at least one rotor vane includes a rotor vane first pin projecting axially from a first axial endface of the at least one rotor vane and a rotor vane second pin projecting axially from an opposed second axial endface of the at least one rotor vane, and wherein each of the rotor vane first pin and the rotor vane second pin is received in a respective aperture in the first rotor disc and the second rotor disc, respectively, for pivotally supporting the at least one rotor vane.

17. The rotary drive of claim 11, wherein the at least one inlet extends axially through the first end cap, and the at least one outlet extends axially through the second end cap.

18. The rotary drive of claim 11, further comprising a vane pivoting mechanism for pivoting at least one of the at least one stator vane and the at least one rotor vane in at least one direction between the open and closed positions when the shaft rotates through at least one predetermined angular position.

19. The rotary drive of claim 11, wherein the first end cap includes a first stator disc fixed relative to the casing and the second end cap includes a second stator disc fixed relative to the casing, and wherein the at least one stator vane extends axially between a first end pivotally supported by the first stator disc and a second end pivotally supported by the second stator disc.

20. The rotary drive of claim 11, wherein the at least one rotor vane comprises at least two rotor vanes each pivotable about a respective rotor vane axis, and the at least one stator vane comprises at least two stator vanes each pivotable about a respective stator vane axis.

* * * * *